US009046872B2

(12) United States Patent
Ikeda et al.

(10) Patent No.: US 9,046,872 B2
(45) Date of Patent: Jun. 2, 2015

(54) COOLING DEVICE AND IMAGE FORMING APPARATUS INCORPORATING SAME

(71) Applicants: Keisuke Ikeda, Kanagawa (JP); Makoto Nakura, Ibaraki (JP); Susumu Tateyama, Ibaraki (JP); Hiroaki Miyagawa, Ibaraki (JP); Yasuaki Toda, Kanagawa (JP); Yutaka Shoji, Kanagawa (JP); Kenji Ishii, Ibaraki (JP); Kenichi Takehara, Kanagawa (JP); Hiromitsu Fujiya, Kanagawa (JP); Keisuke Yuasa, Kanagawa (JP); Shinji Kato, Kanagawa (JP); Tomoyasu Hirasawa, Kanagawa (JP)

(72) Inventors: Keisuke Ikeda, Kanagawa (JP); Makoto Nakura, Ibaraki (JP); Susumu Tateyama, Ibaraki (JP); Hiroaki Miyagawa, Ibaraki (JP); Yasuaki Toda, Kanagawa (JP); Yutaka Shoji, Kanagawa (JP); Kenji Ishii, Ibaraki (JP); Kenichi Takehara, Kanagawa (JP); Hiromitsu Fujiya, Kanagawa (JP); Keisuke Yuasa, Kanagawa (JP); Shinji Kato, Kanagawa (JP); Tomoyasu Hirasawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/182,734

(22) Filed: Feb. 18, 2014

(65) Prior Publication Data

US 2014/0233996 A1 Aug. 21, 2014

(30) Foreign Application Priority Data

Feb. 20, 2013 (JP) ..... 2013-030651
May 17, 2013 (JP) ..... 2013-105536

(51) Int. Cl.
*G03G 21/20* (2006.01)
*G03G 15/00* (2006.01)

(52) U.S. Cl.
CPC ..... *G03G 21/20* (2013.01); *G03G 15/6573* (2013.01)

(58) Field of Classification Search
None
See application file for complete search history.

(56) References Cited

U.S. PATENT DOCUMENTS 7,697,878 B2 * 4/2010 Condello et al. ..... 399/329
2008/0181688 A1 * 7/2008 Kurita ..... 399/341
2010/0239292 A1 * 9/2010 Fujita et al. ..... 399/66

(Continued)

FOREIGN PATENT DOCUMENTS

JP 2011-057389 3/2011
JP 2011-123260 6/2011

(Continued)

OTHER PUBLICATIONS

U.S. Appl. No. 14/140,854, filed Dec. 26, 2013.
U.S. Appl. No. 14/140,888, filed Dec. 26, 2013.
U.S. Appl. No. 13/958,014, filed Aug. 2, 2013.

*Primary Examiner* — Clayton E. Laballe
*Assistant Examiner* — Jas Sanghera
(74) *Attorney, Agent, or Firm* — Oblon, McClelland, Maier & Neustadt, L.L.P.

(57) ABSTRACT

A cooling device includes a cooling member to cool a recording material. The cooling member includes a cooling surface member, a heat exchanging member, and a fastening member. The cooling surface member has a cooling surface to directly or indirectly contact the recording material and absorb heat of the recording material to cool the recording material. The heat exchanging member is directly or indirectly joined to the cooling surface member to radiate heat absorbed by the cooling surface member directly or indirectly via a radiation member. The fastening member fastens the cooling surface member and the heat exchanging member to retain a joined state in which the cooling surface member and the heat exchanging member are directly or indirectly joined to each other. The cooling surface member and the heat exchanging member are separable from the joined state to a separated state without damaging the fastening member.

17 Claims, 19 Drawing Sheets

(56) References Cited

U.S. PATENT DOCUMENTS

| | | | | |
|---|---|---|---|---|
| 2012/0224898 | A1* | 9/2012 | Amita et al. | 399/341 |
| 2012/0315069 | A1 | 12/2012 | Ikeda et al. | |
| 2012/0328343 | A1* | 12/2012 | Kunii et al. | 399/341 |
| 2013/0259512 | A1 | 10/2013 | Ikeda et al. | |

FOREIGN PATENT DOCUMENTS

| | | |
|---|---|---|
| JP | 2012-098677 | 5/2012 |
| JP | 2012-173640 | 9/2012 |
| JP | 2013-025038 | 2/2013 |

* cited by examiner

COOLING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2013-030651, filed on Feb. 20, 2013, and 2013-105536, filed on May 17, 2013, in the Japan Patent Office, the entire disclosure of each of which is hereby incorporated by reference herein.

BACKGROUND

1. Technical Field

Embodiments of this disclosure relate to a cooling device to cool a recording material while sandwiching and conveying the recording material and an image forming apparatus incorporating the cooling device.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Electrophotographic image forming apparatuses have a fixing device to fuse toner under heat and fix a toner image on a recording material (e.g., a sheet of paper). In such an electrophotographic image forming apparatus, recording materials having toner images fixed thereon may be stacked on, e.g., an output tray. In such a case, the recording materials having toner images are stacked one on another on the output tray in heated state. As a result, toner is softened by heat retained in the stacked recording materials, and pressure due to the weight of the stacked recording materials may cause the recording materials to adhere to each other with softened toner. If the recording materials adhering to each other are forcefully separated, the fixed toner images might be damaged. Such an adhering state of the stacked recording materials is referred to as blocking.

To suppress blocking, a cooling device may be used to cool a recording material after a toner image is fixed on the recording material under heat. To cool a recording material, different types of device (hereinafter, cooling device) are proposed including a cooling member with a cooling surface to directly or indirectly contact the recording material and absorb heat of the recording material for cooling.

As a way of bringing the cooling surface into contact with a cooling target, for example, the following device is proposed. For example, in a cooling device, a cooling surface of a cooling member directly contacts a recording material to cool the recording material (hereinafter, direct contact system). For the direct-contact-type cooling member, for example, a recording material slides over a cooling surface of the cooling member, or a cooling surface (outer surface) of the cooling member having a roller shape contacts a recording material and is moved in response to conveyance (movement) of the recording material. Alternatively, in a cooling device, a cooling surface of a cooling member contacts not directly but indirectly with a recording material via an endlessly movable belt member (hereinafter, endless belt) to cool the recording material (hereinafter, indirect contact system). Recently, in any of the direct contact system and the indirect contact system, to obtain a good balance between cooling efficiency and space saving, cooling devices have increasingly employed a configuration in which a recording material or an endless belt sides over a flat or curved cooling surface, which is likely to obtain a wider area of the cooling surface.

In addition, for heat absorption and radiation, for example, the following systems are proposed. For example, for an air cooling system, a blower blows air against a radiation member, such as a cooling fin connected directly or indirectly (via a heat transmitter, such as heat pipe) to a cooling member, to radiate heat absorbed by a cooling surface of a cooling member. Alternatively, for a liquid cooling system, a cooling member includes a channel for cooling liquid. A radiation member, such as a radiator, disposed outside the cooling member and a liquid feed unit, such as a pump, are connected to the channel of the cooling member via tube channels, such as pipes. When the cooling liquid is circulated by the liquid feed unit, a cooling surface of the cooling member absorbs heat of the cooling liquid and a radiation member radiates heat to the outside. Furthermore, in another system, a heat transmitter is directly disposed in a cooling member. A Peltier device is connected to the cooling member to radiate heat, utilizing a Peltier effect that, when electric current flows through a joint portion between two different types of metal, heat transfers from one metal to the other metal.

For example, JP-2012-173640-A proposes a cooling device to cool a recording material while sandwiching and conveying the recording material by two sandwiching units having endless belts. The cooling device employs a liquid cooling system and an indirect contact system to slide an endless belt over a cooling surface of a cooling member. An inner circumferential surface of the endless belt of one of the sandwiching units (at a side facing toner fixed on a recording material) slides over the cooling surface of the cooling member. For the cooling device, a base material of the cooling member is post processed to form an internal channel for circulating the cooling liquid. To improve drainage of condensation occurring on surfaces of the cooling member, post-processing, such as surface processing for water repellency, is conducted on the cooling surface or other surfaces of the cooling member.

BRIEF SUMMARY

In at least one exemplary embodiment of this disclosure, there is provided a cooling device including a cooling member to cool a recording material. The cooling member includes a cooling surface member, a heat exchanging member, and a fastening member. The cooling surface member has a cooling surface to directly or indirectly contact the recording material and absorb heat of the recording material to cool the recording material. The heat exchanging member is directly or indirectly joined to the cooling surface member to radiate heat absorbed by the cooling surface member directly or indirectly via a radiation member. The fastening member fastens the cooling surface member and the heat exchanging member to retain a joined state in which the cooling surface member and the heat exchanging member are directly or indirectly joined to each other. The cooling surface member and the heat exchanging member are separable from the joined state to a separated state without damaging the fastening member.

In at least one exemplary embodiment of this disclosure, there is provided an image forming apparatus incorporating the above-described cooling device.

In at least one exemplary embodiment of this disclosure, there is provided a cooling device including a cooling member to cool a recording material. The cooling member includes a cooling surface member, a heat exchanging member, and a fastening member. The cooling surface member has a cooling surface to directly or indirectly contact the recording material and absorb heat of the recording material to cool the recording material. The heat exchanging member is directly or indirectly joined to the cooling surface member to radiate heat absorbed by the cooling surface member directly or indirectly via a radiation member. The fastening member fastens the cooling surface member and the heat exchanging member to retain a joined state in which the cooling surface member and the heat exchanging member are directly or indirectly joined to each other. The cooling surface member and the heat exchanging member are separable from the joined state to a separated state and joinable from the separated state to the joined state.

In at least one exemplary embodiment of this disclosure, there is provided an image forming apparatus incorporating the above-described cooling device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
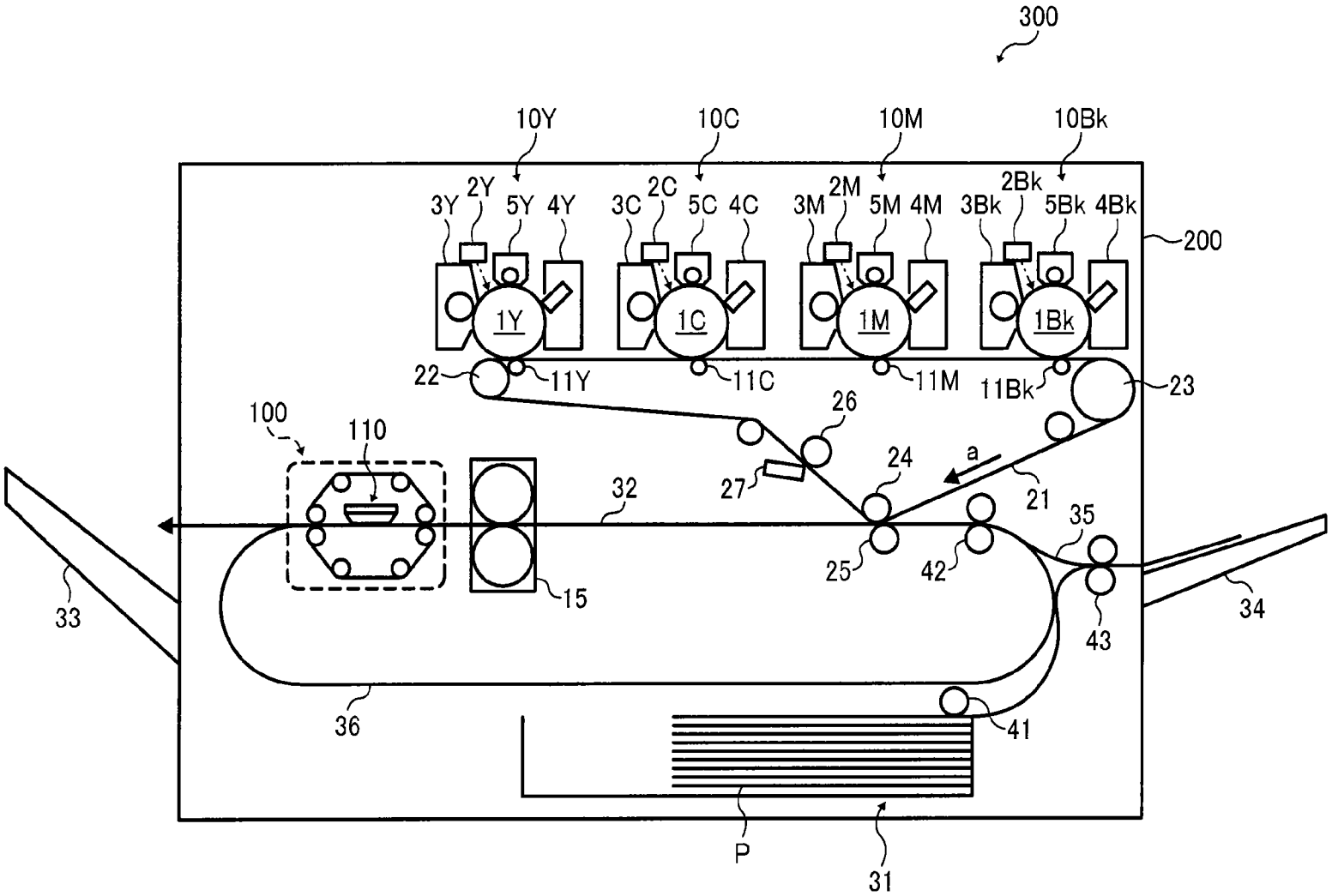
FIG. 1 is a schematic view of an image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, it will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Below, an image forming apparatus including a cooling device according to an embodiment of this disclosure is described with reference to drawings.

First, an image forming apparatus 300 according to an embodiment of this disclosure is described below. FIG. 1 is a schematic configuration view of the image forming apparatus 300 according to an embodiment of this disclosure.

As illustrated in FIG. 1, in this embodiment, the image forming apparatus 300 includes an intermediate transfer belt 21 serving as an intermediate transfer body in an apparatus body 200. The intermediate transfer belt 21 is stretched over plural rollers (e.g., a first tension roller 22, a second tension roller 23, a third tension roller 24). By rotation of one of the plural rollers, the intermediate transfer belt 21 is driven to rotate in a direction indicated by arrow "a" in FIG. 1. For the image forming apparatus 300, process units for image formation are disposed around the intermediate transfer belt 21. Subscripts Y, C, M, and Bk after numeral codes indicate specifications for yellow, cyan, magenta, and black, respectively.

When the rotation direction of the intermediate transfer belt 21 is indicated by arrow "a" in FIG. 1, four imaging stations 10Y, 10C, 10M, and 10Bk serving as process units for image formation corresponding to the respective colors are disposed between the first tension roller 22 and the second tension roller 23 above the intermediate transfer belt 21. The image station 10Y for yellow image, the image station 10C for cyan image, the image station 10M for magenta image, and the image station 10Bk for black image are arranged in this order from an upstream side in a surface moving direction of the intermediate transfer belt 21.

The imaging stations 10Y, 10C, 10M, and 10Bk have substantially the same configuration except for the different toner colors. In each of the image stations 10, a charging device 5, an optical writing device 2, a development device 3, and a photoconductor cleaning device 4 are disposed around a photoconductor 1 having a drum shape. In addition, at a position opposing the photoconductor 1 via the intermediate transfer belt 21 is disposed a primary transfer roller 11 serving as a transfer unit to transfer a toner image onto the intermediate transfer belt 21. The imaging stations 10Y, 10C, 10M, and 10Bk are arranged at certain pitches from each other along the surface moving direction of the intermediate transfer belt 21.

The optical writing device 2 exposes each the photoconductor 1 in accordance with image information. For the image forming apparatus 300, the optical writing device 2 is, e.g., an optical system using a light emitting diode (LED) as a light source. In some embodiments, the optical writing device 2 may be formed of a laser optical system using a semiconductor laser as a light source.

Below the intermediate transfer belt 21 are disposed a feed tray 31, a feed roller 41, and paired registration rollers 42. The feed tray 31 stores sheets P serving as sheet-type recording materials. A secondary transfer roller 25 serving as a transfer unit to transfer a toner image from the intermediate transfer belt 21 onto a sheet P is disposed opposing the third tension roller 24 via the intermediate transfer belt 21. A belt cleaning device 27 to clean an outer surface of the intermediate transfer belt 21 is disposed to contact the outer surface of the intermediate transfer belt 21 at a position at which a cleaning opposed roller 26 contacting an inner surface of the intermediate transfer belt 21 contacts the intermediate transfer belt 21. In FIG. 1, at the right side of the registration rollers 42 are disposed a feed path 35, a feed roller 43, and a bypass tray 34 which are used for bypass feed.

A sheet transport path 32 extends from the feed tray 31 to an output tray 33. At a downstream side from the secondary transfer roller 25 in a sheet transport direction in the sheet transport path 32 (hereinafter referred to as simply "downstream side) is disposed a fixing device 15 including a heating roller and a pressure roller. On the downstream side from the fixing device 15 in the sheet transport path 32 is disposed a cooling device 100 to cool the sheet P. At an exterior of the apparatus body 200 on the downstream side further from the cooling device 100 is disposed the output tray 33 serving as an output unit of the sheet P after toner fixing. The image forming apparatus 300 also includes a reverse transport path 36 for duplex (dual-face) image formation. When an image is formed on a back face of a sheet P in duplex image formation, the sheet P having passed the cooling device 100 is turned around and transported again to the registration rollers 42 via the reverse transport path 36.

An image formation process is described below taking an example of one image station 10. According to a general electrostatic recording method, in the darkness, the optical writing device 2 irradiates light onto the photoconductor 1 uniformly charged by the charging device 5 to form an electrostatic latent image. The development device 3 supplies toner to the electrostatic latent image on the photoconductor 1 to form a toner image as a visible image. The primary transfer roller 11 transfers the toner image from the photoconductor 1 to the intermediate transfer belt 21. After the transfer, the photoconductor cleaning device 4 cleans an outer surface of the photoconductor 1. Such an image formation process is performed in each of the imaging stations 10Y, 10C, 10M, and 10Bk.

The development devices 3Y, 3C, 3M, and 3Bk in the imaging stations 10Y, 10C, 10M, and 10Bk have visible-image forming functions with the respective color toners. Accordingly, yellow, cyan, magenta, and black are allocated to the imaging stations 10Y, 10C, 10M, and 10Bk, thus allowing formation of a full-color composite image. Each imaging station 10 includes the primary transfer roller 11 disposed opposing the corresponding photoconductor 1 so as to sandwich the intermediate transfer belt 21 between the primary transfer roller 11 and the photoconductor 1. The primary transfer roller 11 is supplied with a transfer bias to form a primary transfer unit.

For the above-described configuration, a common image formation area of the intermediate transfer belt 21 passes the imaging stations 10Y, 10C, 10M, and 10Bk in turn. When the common image formation area passes the imaging stations 10Y, 10C, 10M, and 10Bk in turn, respective single-color toner images are transferred to the intermediate transfer belt 21 by the transfer biases supplied to the primary transfer rollers 11 so that the single-color toner images are superimposed one on another on the intermediate transfer belt 21. Thus, when the above-described common image formation area passes the primary transfer unit of each of the imaging stations 10Y, 10C, 10M, and 10Bk once, a full-color toner image is formed on the common image formation area by the superimposing transfer.

The full-color toner image formed on the intermediate transfer belt 21 is secondarily transferred onto a sheet P fed from the feed tray 31 or the bypass tray 34. After the secondary transfer, the belt cleaning device 27 cleans the intermediate transfer belt 21. Here, the transfer of the full-color toner image from the intermediate transfer belt 21 to the sheet P is performed as follow. For the secondary transfer, a transfer bias is supplied to the secondary transfer roller 25 to form a transfer electric field between the secondary transfer roller 25 and the third tension roller 24 via the intermediate transfer belt 21. The secondary transfer is performed by passing the sheet P through a transfer nipping portion between the secondary transfer roller 25 and the intermediate transfer belt 21. The registration rollers 42 are disposed upstream from the transfer nipping portion in the sheet transport direction. The sheet P fed from the feed tray 31 or the bypass tray 34 is fed by the registration rollers 42 into the transfer nipping portion so as to synchronize the full-color toner image on the intermediate transfer belt 21 conveyed to the transfer nipping portion.

After the secondary transfer of the full-color toner image from the intermediate transfer belt 21 to the sheet P, the fixing device 15 applies heat and pressure to the full-color toner image on the sheet P to fix the full-color toner image on the sheet P, thus forming the final full-color image on the sheet P. Then, the sheet P is cooled from a single face side or both face sides by the cooling device 100 and stacked on the output tray 33. When the sheet P is stacked on the output tray 33, such a configuration can reliably harden toner on the sheet P, thus preventing blocking phenomenon.

Next, configurations of a cooling device 100 according to embodiments of the present disclosure is described below.

Here, in a cooling device 100 according to each of the embodiments, a cooling member 110 directly or indirectly contacts a sheet P serving as a recording material is comprised of at least two separable members. In the following descriptions, the same reference codes are allocated to the same members or components having similar functions unless particularly specified. In addition, in the following description, the term "front side" of a sheet P represents a side of the sheet P on which toner adheres in a softened state after heating and pressing by the fixing device 15, and the term "back side" represents a side of the sheet P opposite the side on which softened toner adheres. The term "sheet transport direction" represents a direction parallel to the transport direction of the sheet P to directly or indirectly contact the cooling member 110 of the cooling device 100. The term "sheet width direction" represents a direction parallel to a sheet face of the sheet P to directly or indirectly contact the cooling member 110 and perpendicular to the sheet transport direction.

First, a cooling device 100 according to an embodiment is described with reference to FIGS. 2, 3A, 3B, and 3C.

Figure 2:
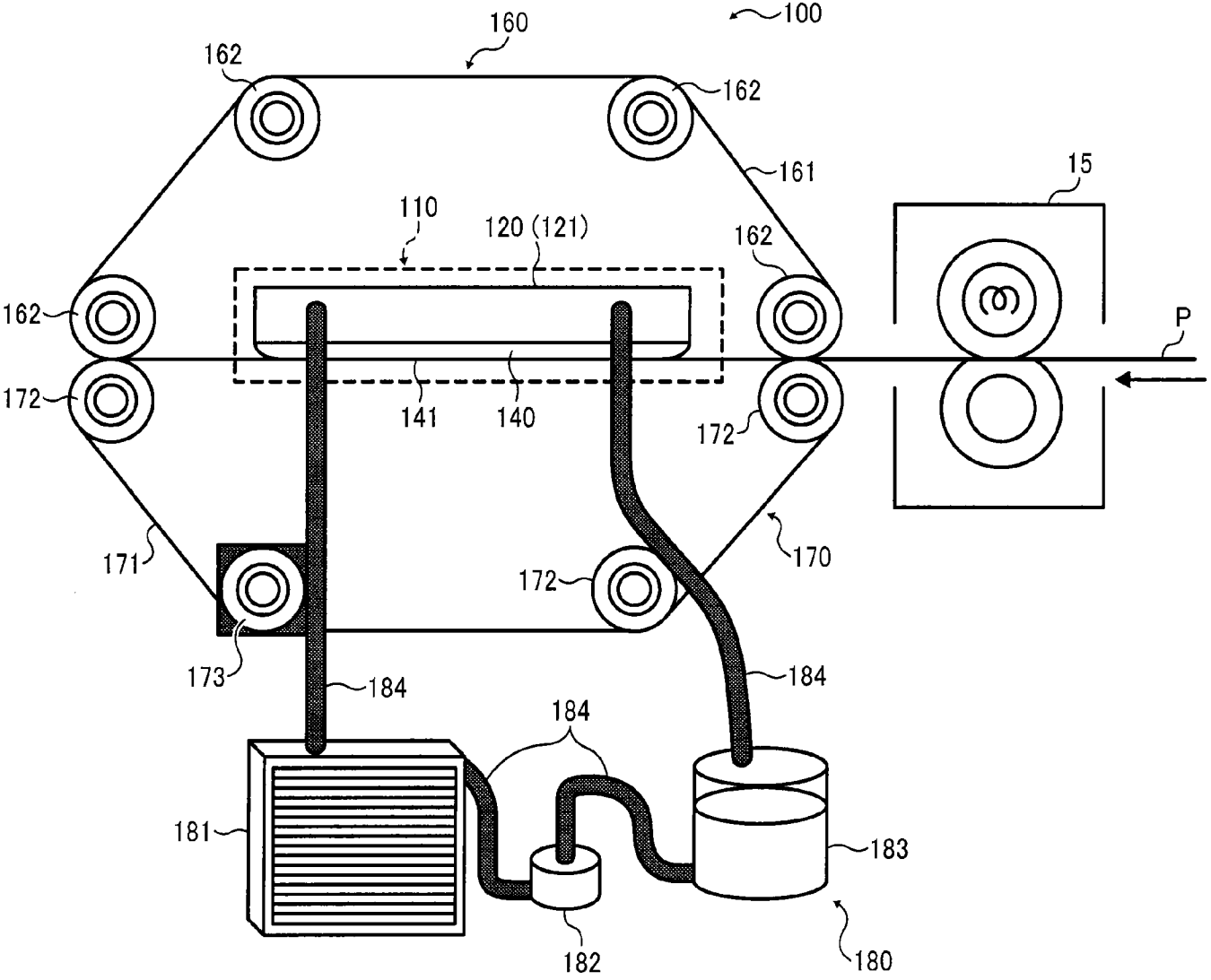
FIG. 2 is a schematic view of a cooling device according to an embodiment of this disclosure.
Figure 3A:
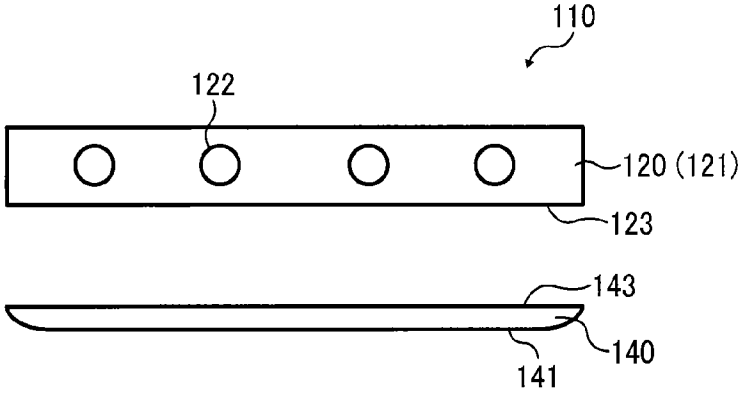
FIGS. 3A through 3C are schematic views of examples of a cooling member according to an embodiment of this disclosure.
Figure 3C:
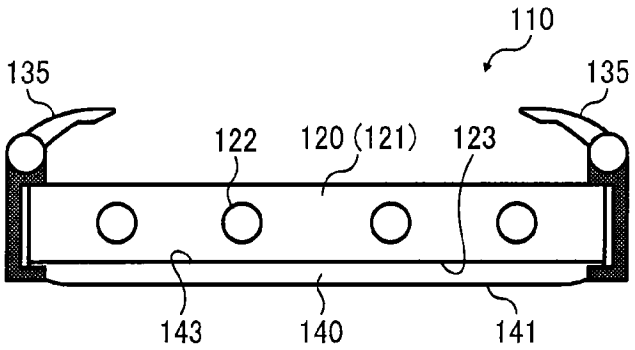
Figure 3B:
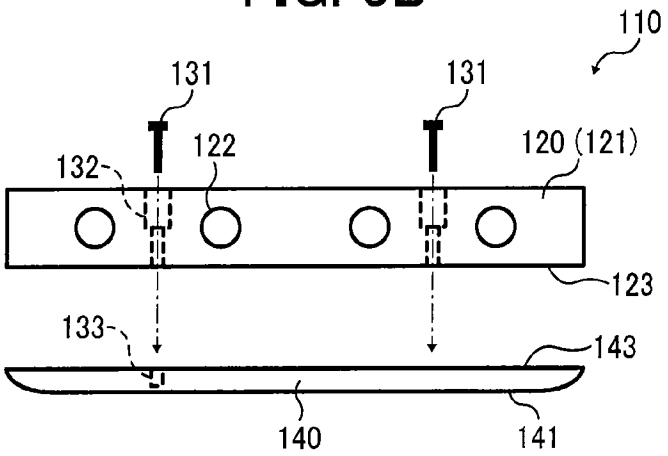

FIG. 2 is a schematic view of an example of the cooling device 100 according to this embodiment. FIGS. 3A to 3C are schematic views of an example of a cooling member 110 of the cooling device 100 according to this embodiment. FIG. 3A is a schematic view of a heat exchanging member 120 and a cooling surface member 140 of the cooling member 110. FIG. 3B is a schematic view of a configuration of fastening the heat exchanging member 120 and the cooling surface member 140 with screws. FIG. 3C is a schematic view of a configuration of fastening the heat exchanging member 120 and the cooling surface member 140 with clamps 135.

In the example illustrated in FIG. 2, the cooling device 100 has two sandwiching parts, i.e., a front-side sandwiching part 160 and a back-side sandwiching part 170 to sandwich and convey the sheet P after the fixing device 15 fixes an image on the sheet P. The front-side sandwiching part 160 sandwiches the sheet P from the front side of the sheet P on which toner adheres in a softened state. The back-side sandwiching part 170 sandwiches the sheet P from the back side of the sheet P. The cooling device 100 also has a liquid-cooling-type external radiator 180. The external radiator 180 absorbs heat from the sheet P in an indirect contact manner via the cooling member 110 made of metal (e.g., aluminum) disposed in the front-side sandwiching part 160, and radiates heat to ambient atmosphere.

The front-side sandwiching part 160 includes, e.g., four front-side follow rollers 162, a front-side endless belt 161, and the cooling member 110. The front-side follow rollers 162 are arranged so as to form a trapezoid shape above the sheet transport path 32 in FIG. 2. The front-side endless belt 161 is stretched over the four front-side follow rollers 162. The back-side sandwiching part 170 includes, e.g., three back-side follow rollers 172, a driving roller 173, and a back-side endless belt 171. The back-side follow rollers 172 are arranged so as to form a trapezoid shape below the sheet transport path 32 in FIG. 2. The back-side endless belt 171 is stretched over the back-side follow rollers 172 and the driving roller 173. The back-side follow rollers 172 are connected via a drive transmission unit, such as a gear train, to a driving motor serving as a driving source exclusively used or shared with another driving system.

The external radiator 180 includes, e.g., a radiator 181 serving as a heat radiation member, a liquid feed pump 182 to deliver cooling liquid, a liquid storage tank 183 to store the cooling liquid, and a rubber tube 184 serving as a channel to connect each of the above-described components/members and the cooling member 110 to form a circulation channel of the cooling liquid. The cooling liquid circulating through the circulation channel serves as a heat transmitter to absorb heat of the sheet P with the cooling member 110 via the front-side endless belt 161 and transmit the absorbed heat to the radiator 181. In this embodiment, the external radiator 180 also has a blowing fan serving as a blower to blow an outside air to the radiator 181 to enhance the heat radiation effect, i.e., the cooling effect of the sheet P.

For the cooling device 100 thus configured, the back-side follow rollers 172 are driven to rotate counterclockwise in FIG. 2 to endlessly move the back-side endless belt 171 counterclockwise. The back-side endless belt 171 contacts the front-side endless belt 161 directly or indirectly via the sheet P. Thus, the endless movement of the back-side endless belt 171 causes the front-side endless belt 161 to endlessly move clockwise in FIG. 2. By sandwiching the sheet P with the front-side endless belt 161 and the back-side endless belt 171 endlessly moving as described above, the sheet P having an image fixed thereon can be conveyed in a sandwiched state along the sheet transport path 32.

The liquid feed pump 182 is activated to circulate the cooling liquid between a flow channel 122 (see FIG. 7A) of the cooling member 110 and the radiator 181. Thus, a cooling surface 141 of the cooling member 110 to indirectly contact the sheet P via the front-side endless belt 161 can absorb heat from the sheet P to cool the sheet P. For example, as described above, the cooling member 110 includes the flow channel 122 serving as a channel through which the cooling liquid passes. The cooling surface 141 of the cooling member 110 slides against the front-side endless belt 161 to absorb heat (a quantity of heat) from the sheet P, and the cooling liquid transports the heat to the outside of the cooling member 110. Thus, the cooling member 110 is maintained at relatively low temperature. In this embodiment, the cooling liquid is stored in the liquid storage tank 183 and is fed by the liquid feed pump 182. When the cooling liquid passes through the radiator 181, heat of the cooling liquid is radiated to the outside air, thus reducing the temperature of the cooling liquid.

When the cooling liquid thus cooled passes though the flow channel 122 in the cooling member 110, the cooling liquid absorbs heat from the cooling member 110 by heat transfer. The cooling liquid thus heated to a high temperature returns to the liquid storage tank 183. During driving of the liquid feed pump 182, the cooling liquid circulates between the flow channel 122 of the cooling member 110 and the radiator 181. Thus, heat radiation of the cooling liquid in passing through the radiator 181 and heat absorption of the cooling liquid in passing through the flow channel 122 in the cooling member 110 are repeated. By cooling the sheet P as described above, the temperature of toner heated and softened in the fixing device 15 is reduced, thus reliably hardening toner on the sheet P. Thus, when sheets P having toner images are discharged and stacked on the output tray 33 illustrated in FIG. 1, such a configuration can suppress occurrence of blocking phenomenon.

However, the cooling device 100 employing an indirect contact system in which the front-side endless belt 161 slides against the cooling surface 141 of the cooling member 110 may have the following challenge. For example, in a long term of use, sliding of the front-side endless belt 161 against the cooling surface 141 may cause wearing of the cooling surface 141. Using the cooling surface 141 in a worn state might reduce the cooling efficiency, damage the front-side endless belt 161, or hamper the effect obtained by surface-processing the cooling surface 141 of the cooling member 110.

Accordingly, when the cooling surface 141 is worn, maintenance work is performed to improve the condition of the cooling surface 141. Typically, it is conceivable to replace the cooling member 110 having the cooling surface 141. However, the cooling member 110 on which post-processing, such as surface processing, is performed is higher in production cost than a cooling member of which post processing is not performed on a substrate serving as a base material. As a result, the maintenance cost of the cooling surface 141 of the cooling member 110 may increase, depending on the configuration of the cooling device 100.

In addition, for the above-described liquid-cooling-type, the cooling member 110 might have the following challenge. For example, the rubber tube 184 connects the cooling member 110 including a channel of the cooling liquid to, e.g., the liquid feed pump 182 to circulate the cooling liquid or the radiator 181 to radiate heat absorbed by the cooling liquid to the outside air. If a configuration is employed in which the rubber tube 184 is not so easily attachable or detachable, the cooling device 100 may be entirely replaced. Such a configuration of replacing the entire cooling device 100 is quite higher in replacement cost than a configuration in which the rubber tube 184 is easily attachable and detachable. Here, the replacement cost of the rubber tube 184 in the configuration in which the rubber tube 184 is easily attachable and detachable includes, e.g., costs of the replacement of the cooling member 110 having the worn cooling surface 141, the replacement of the cooling liquid accompanying with the replacement of the cooling member 110, and the replacement of gaskets or other consumable supplies.

Moreover, the following challenge may occur in maintenance work of the cooling surface 141 of the cooling member 110. For the maintenance work of the cooling surface 141, as described above, in advance, the cooling liquid is removed from the cooling member 110, gaskets or other consumable supplies are replaced, or the cooling liquid is replenished into the circulation channel after replacement of the cooling member 110. Accordingly, it may be difficult to provide the cooling device 100 having good operability in the maintenance work of the cooling surface 141 of the cooling member 110.

Furthermore, in a direct contact system in which the cooling member 110 directly contacts the sheet P, as well as an indirect contact system like this embodiment, a configuration may also be employed in which the cooling member 110 has the cooling surface 141 against which a sheet P or an endless belt, such as the front-side endless belt 161, slides. Such a configuration may have the following challenge. As described above, the cooling member 110 radiates heat of the sheet P, which is absorbed by the cooling surface 141, from a radiation member directly or indirectly via a heat transmitter. Typically, post processing is performed on a base material produced by, e.g., extrusion molding. For such a configuration of performing post processing, an increase in the level of difficulty or person hour of post processing might increase the post-processing cost.

For the configuration in which the cooling member 110 directly irradiates heat of the sheet P, for example, the cooling surface 141 and a cooling fin may be directly formed in the cooling member 110. Alternatively, a cooling fin formed as a separate member may be joined to the cooling member 110 having the cooling surface 141 by, e.g., swaging or pressure welding (adhesion or welding). Here, in the configuration in which the cooling surface 141 or a cooling fin may be directly formed in the cooling member 110, after the cooling surface 141 is processed into a desired surface shape by, e.g., extrusion molding, the cooling fin or other parts are machined to produce the cooling member 110. Alternatively, the cooling member 110 is produced by machining the cooling surface 141 and the cooling fin from a solid base member or by casting the cooling surface 141 and the cooling fin with a mold.

By contrast, for the configuration in which heat of the sheet P is radiated from the radiator 181 via the cooling liquid serving as a heat transmitter as in this embodiment, the flow channel 122 to flow the cooling liquid is formed in the cooling member 110 as follow. For example, it is conceivable to employ a configuration in which the cooling surface 141 or a channel for the cooling liquid is directly formed in the cooling member 110. Alternatively, a configuration is conceivable in which a groove to fit a tube channel of the cooling liquid, which is a separate member, and a cooling surface are formed in base members and bonded together after the tube channel is fitted into the groove. Here, in the configuration in which the cooling surface 141 and a cooling fin may be directly formed in the cooling member 110, after the cooling surface 141 is processed into a desired surface shape by, e.g., extrusion molding, the flow channel 122 is machined to produce the cooling member 110. Alternatively, the cooling member 110 is produced by machining the cooling surface 141 and the flow channel 122 from a solid base member or by casting the cooling surface 141 and the flow channel 122 with a mold.

In any of the above-described configurations or methods, if the shape of the cooling surface 141, the cooling fin, or the flow channel 122 formed by post-processing the cooling member 110 is complicated, the post-processing would be difficult and the production cost of the cooling member 110 would be further increased. In a case in which post-processing, such as surface processing performed on the cooling surface 141 of the cooling member 110 to prevent corrosion or enhance the surface property includes a step of heat processing, the heat processing might affect the cooling surface to cause a deviation from the target flatness or curvature, thus reducing production yield. For example, for a configuration in which a base-member portion of the cooling member 110 is thin and the cooling fin or other part is an integral part of the base member portion, a portion of the base member that is uneven in thickness or strength may increase. As a result, the base member is likely to deform due to post-processing, such as surface processing, thus reducing production yield. Then, the post-processing may become difficult, thus increasing the production cost of the cooling member 110.

Accordingly, for a conventional type of cooling device, even if a cooling member is produced according to any of the above-described configurations or methods, the cooling member would be more difficult to produce and higher in production cost, thus hampering cost reduction of the cooling device. In improving the condition of the deteriorated cooling surface 141 of the cooling member 110, the cooling member 110, which is a member raising the production cost as described above, is replaced, thus hampering a reduction in maintenance cost of the deteriorated cooling surface of the cooling member 110. In this regard, the configuration in which the cooling fin or other part is produced as a separate member and bonded to the cooling member 110 by swaging may also have the following challenge. For example, if an operator tries to separate the cooling member 110 from the cooling fin or other part to replace only the cooling member 110, a swaged portion for fastening (joining) the cooling fin to the cooling member 110 would be damaged. As a result, in replacing the cooling member 110, the cooling fin and so on cannot be reused. Thus, in conducting maintenance on the deteriorated cooling surface 141 of the cooling member 110, the cooling member 110 would be replaced together with the cooling fin and so on joined to the cooling member 110 by swaging.

Hence, for the cooling device 100 according to this embodiment, the cooling member 110 has the following configuration.

As illustrated in FIG. 3A, the cooling member 110 includes, mainly, two separable metal members, that is, the cooling surface member 140 and the heat exchanging member 120. The cooling surface member 140 has the cooling surface 141 to slidingly contact the front-side endless belt 161. The heat exchanging member 120 includes the flow channel 122 through which the cooling liquid passes. By forming the cooling member 110 with at least two members, with the two or more members separated from each other, the cooling member 110 can be produced or maintenance work can be performed on the cooling surface 141. In addition, during activation, the two or more members are joined together in a fastening way and can be used as the cooling member 110.

In production, only post-processing necessary for each of the cooling surface member 140 and the heat exchanging member 120 can be conducted to produce the cooling surface member 140 and the heat exchanging member 120 at low cost and in a simple way. Such a configuration can reduce the production cost of the cooling member 110 and conduct post-processing on the cooling member 110 in a simpler manner than a configuration in which the cool face member and the heat exchanging member are formed as a single member.

As the fastening way to join the cooling surface member 140 with the heat exchanging member 120, for example, a screw fastening system using screws 131 illustrated in FIG. 3B or a clamp fastening system using the clamps 135 can be employed to properly join the cooling surface member 140 with the heat exchanging member 120. Any of the above-described systems can be configured to prevent damage to the fastening system.

For the screw fastening system, when the cooling surface member 140 and the heat exchanging member 120 are joined by fastening, screw holes are disposed at positions outside a contact area of the cooling surface 141 at which the cooling surface 141 slidingly contacts the front-side endless belt 161. Alternatively, a configuration may be employed in which the screws 131 do not pass through the cooling surface member 140. Alternatively, in a case in which the screws 131 are inserted from the cooling surface member 140 side to the heat exchanging member 120 side for screw fastening, for example, countersunk holes are provided at the cooling surface 141 side so that protrusions are not formed in the contact area at which the cooling surface 141 slidingly contacts the front-side endless belt 161.

For example, in the example illustrated in FIG. 3B, the heat exchanging member 120 has screw through-holes 132 to pass through a joint surface 123 and countersunk holes at a surface opposite the joint surface 123 to join the cooling surface member 140. The cooling surface member 140 has a joint surface 143 at a side at which the heat exchanging member 120 is joined, and includes screw fastening holes 133 that are formed from the joint surface 143 so as not to pass through to the cooling surface side. When the heat exchanging member 120 and the cooling surface member 140 are joined by fastening, the screws 131 are inserted from the screw through-holes 132 (having the countersunk holes) of the heat exchanging member 120 into the screw fastening holes 133 of the cooling surface member 140 to fasten the heat exchanging member 120 and the cooling surface member 140 by the screws 131. Such a configuration allows fastening and unfastening of the heat exchanging member 120 and the cooling surface member 140 without damaging the screws 131, the screw through-holes 132, and the screw fastening holes 133 serving as fastening members. In other words, such a configuration allows switching of the heat exchanging member 120 and the cooling surface member 140 between a joined state and a separated state without damaging the screws 131, the screw through-holes 132, and the screw fastening holes 133 serving as fastening members to maintain the joined state.

For the clamp fastening system, in a case in which the cooling surface member 140 and the heat exchanging member 120 are joined by fastening, the clamps 135 are disposed at positions outside the area of the cooling surface 141 at which the cooling surface 141 slidingly contacts the front-side endless belt 161. Alternatively, the clamps 135 are disposed so as not to contact the front-side endless belt 161. In addition, the cooling surface member 140 has, e.g., recessed portions to engage with engagement portions of the clamps 135. Such a configuration prevents the clamps 135 from contacting the front-side endless belt 161 in assembly and maintenance.

For example, in the example illustrated in FIG. 3C, the clamps 135 have the engagement portions to engage with the recessed portions of the cooling surface member 140 at lower positions in FIG. 3C. The clamps 135 have shaft portions at positions upstream and downstream from each of the heat exchanging member 120 and the cooling surface member 140 in the sheet transport direction of the sheet P. Levers for fastening and unfastening the clamps 135 are disposed at a side of the heat exchanging member 120 distal to the cooling surface member 140. By rotating the levers, the heat exchanging member 120 is pressed against the cooling surface member 140, thus fastening the heat exchanging member 120 and the cooling surface member 140 with the clamps 135. Such a configuration allows fastening and unfastening of the heat exchanging member 120 and the cooling surface member 140 without damaging the clamps 135 serving as fastening members. In other words, such a configuration allows switching of the heat exchanging member 120 and the cooling surface member 140 between a joined state and a separated state without damaging the clamps 135 serving as fastening members to maintain the joined state.

In this embodiment, the cooling surface member 140 and the heat exchanging member 120 are separable without damaging the fastening members employing the screw fastening system or clamp fastening system as described above. Accordingly, when maintenance work is performed on the cooling surface 141 of the cooling member 110 having been worn and deteriorated due to a long use, the condition of the cooling surface 141 can be improved by replacing only the cooling surface member 140 having the cooling surface 141. As described above, in this embodiment, the flow channel 122 of the cooling liquid is disposed in the heat exchanging member 120 instead of the cooling surface member 140. Such a configuration can reduce the maintenance cost of the cooling surface of the cooling member 110 as compared to a configuration in which the cooling surface member and the heat exchanging member are formed as a single member.

In addition, when maintenance work is performed on the cooling surface 141 of the cooling member 110, a member to be replaced is limited to the cooling surface member 140. Such a configuration can obtain good operability in maintenance of the deteriorated cooling surface 141 as compared to the configuration in which the cooling surface member and the heat exchanging member are formed as a single member. In particular, for the liquid-cooling-type cooling device 100 in this embodiment, the flexibly-deformable rubber tube 184 is used as a tube channel connecting the external radiator 180 to the flow channel 122 of the cooling member 110. Accordingly, at least the following work can be omitted. Examples of such work include preliminary removal of the cooling liquid from the cooling member 110, replacement of gaskets or other consumable supplies, or replenishment of the cooling liquid into the circulation channel after replacement of the cooling member 110. Omitting such work allows enhancement of operability in maintenance of the deteriorated cooling surface 141. In other words, when the cooling surface member 140 is worn or damaged by sliding contact with the front-side endless belt 161, such a configuration allows separation and replacement of only the cooling surface member 140 from the heat exchanging member 120, thus reducing cost and effort for the replacement.

Thus, the cooling device 100 according to this embodiment can reduce cost in production of the cooling member 110 to indirectly contact the sheet P to cool the sheet P or maintenance of the cooling surface 141 of the cooling member 110. The cooling device 100 can provide good operability in maintenance of the cooling surface 141 having been deteriorated. As described above, in this embodiment, the cooling device 100 according to the indirect contact system is described in which the cooling surface 141 of the cooling member 110 indirectly contacts the sheet P via the front-side endless belt 161. However, [the above-described configuration of the cooling member 110 in this embodiment is applicable to the cooling device 100 according to the direct contact system in which the cooling surface 141 of the cooling member 110 directly contacts the sheet P.

As described above, the cooling device 100 in this embodiment also includes the front-side sandwiching part 160 serving as a sandwiching unit to sandwich the sheet P serving as the recording material from the front side of the sheet P and the back-side sandwiching part 170 serving as a sandwiching unit to sandwich the sheet P from the back side of the sheet P. The front-side sandwiching part 160 includes the cooling member 110. When the cooling surface 141 of the cooling member 110 indirectly contacts the sheet P, such a configuration can enhance adherence of respective contact surfaces of the cooling surface 141 of the cooling member 110, the front-side endless belt 161 intervened between the cooling surface 141 and the sheet P, and the sheet P, thus enhancing cooling effect. Likewise, for a configuration in which the cooling surface 141 directly contacts the sheet P, adherence between the cooling surface 141 of the cooling member 110 and the sheet P can be enhanced, thus enhancing cooling effect.

For the cooling device 100 according to this embodiment, as described above, the front-side sandwiching part 160 serving as a sandwiching unit including the cooling member 110 includes the front-side endless belt 161 serving as a belt member stretched over plural rollers so as to be endlessly movable. The cooling surface 141 of the cooling surface member 140 contacts the sheet P serving as a recording material via an inner circumferential surface of the front-side endless belt 161. Accordingly, the front-side endless belt 161 slidingly contacts the cooling surface 141 of the cooling surface member 140. The front-side endless belt 161 moves at substantially the same speed as a surface of the sheet P, thus preventing disturbance of softened toner adhering to the surface of the sheet P. Such a configuration can cool the sheet P from the front face side of the sheet P on which softened toner adheres, thus effectively cooling and hardening the softened toner.

Each sandwiching unit, such as the front-side sandwiching part 160 or the back-side sandwiching part 170, includes the front-side endless belt 161 or the back-side endless belt 171 serving as a belt member stretched over plural rollers so as to be endlessly movable. The sheet P serving as a recording material is sandwiched and conveyed by the endless belts of the sandwiching units. Such a configuration can increase a contact area of the cooling surface 141 of the cooling surface member 140 at which the cooling surface 141 contacts the sheet P via the front-side endless belt 161, thus enhancing effect of cooing the sheet P.

The heat exchanging member 120 includes the flow channel 122 constituting a liquid-cooling-type cooler to transmit heat absorbed by the cooling surface member 140 to the radiator 181 for heat radiation. Such a configuration can obtain the following effect. Providing the flow channel 122 in the heat exchanging member 120 can more effectively radiate heat of the sheet P absorbed by the cooling surface member 140 to enhance cooling effect than a configuration in which the heat exchanging member 120 is made of only a base member.

Mounting the cooling device 100 allows the image forming apparatus 300 to provide effects equivalent to those of the image forming apparatus 300 having the above-described cooling device 100.

Next, a cooling device 100 according to another embodiment of this disclosure is described with reference to FIGS. 4 and 5.

Figure 4:
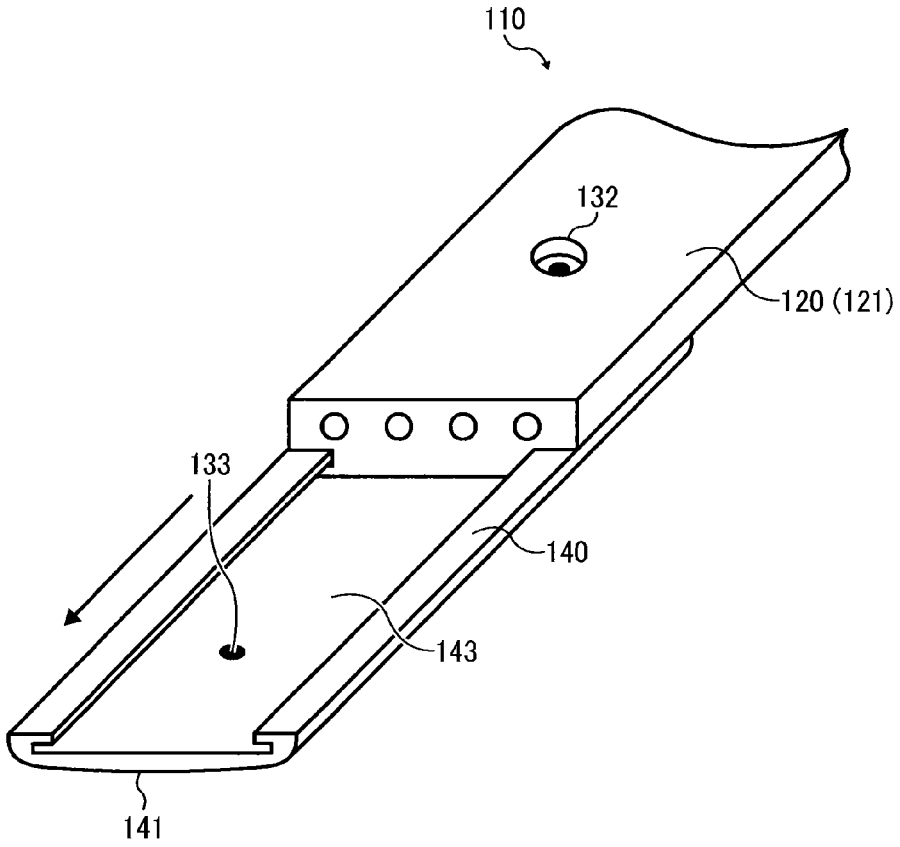
FIG. 4 is a schematic view of a cooling member according to an embodiment of this disclosure.

FIG. 4 is a schematic view of a cooling member 110 according to another embodiment of this disclosure. FIG. 5 is a schematic view of an interface between a heat exchanging member 120 and a cooling surface member 140 in the cooling member 110 of FIG. 4.

This embodiment differs from the above-described embodiment illustrated in FIGS. 3A to 3C in the following points. The different points are a way of joining the heat exchanging member 120 and the cooling surface member 140, a member of filling cracks between joint surfaces of the heat exchanging member 120 and the cooling surface member 140, and a curved surface at least partially formed at a cooling surface 141 of the cooling surface member 140. Except for the different points, this embodiment is substantially the same as the above-described embodiment of FIGS. 3A to 3C. Therefore, substantially the same configuration and action, and operation and effects thereof as the above-described embodiment of FIGS. 3A to 3C are omitted below as needed.

In this embodiment, as illustrated in FIG. 4, each of the cooling surface member 140 and the heat exchanging member 120 has grooves to allow the cooling surface member 140 and the heat exchanging member 120 to slide relative to each other. In replacing the cooling surface member 140, such a configuration allows the cooling surface member 140 to be pulled out toward the front side in FIG. 4 and smoothly replaced. In this embodiment, a base member of the cooling member 110 is made of aluminum as in the above-described embodiment illustrated in FIGS. 3A to 3C. A joint surface 143 of the cooling surface member 140 with the heat exchanging member 120 illustrated in FIG. 4 is coated with heat transfer grease 137 serving as a heat conductive material. As a result, as indicated by cross-hatching in (b) of FIG. 5, even if cracks between the joint surface 143 of the cooling surface member 140 and a joint surface 123 of the heat exchanging member 120 are created by surface roughness or warp of the joint surface 143 and the joint surface 123, the cracks are filled with the heat transfer grease 137.

As described above, filling cracks between the joint surfaces with the heat transfer grease 137 can prevent the cracks from reducing heat transfer efficiency, thus suppressing a reduction in the effect of cooling the sheet P. In other words, even if cracks are created between the joint surface 143 of the cooling surface member 140 and the joint surface 123 of the heat exchanging member 120 by surface roughness or warp of the joint surface 143 and the joint surface 123, applying the heat transfer grease 137 onto the joint surface 143 of the cooling surface member 140 can enhance heat transfer property. Such a configuration can also obtain a desired heat transfer efficiency even if post-processing for preventing occurrence of cracks, such as grinding of each of the joint surfaces into a desired surface shape or rubbing of the joint surfaces against each other is omitted or the accuracy of such post-processing is reduced, In this embodiment, the heat transfer grease 137 is employed. However, in some embodiments, instead of the heat transfer grease 137, a heat conductive sheet (e.g., a heat conductive sheet 138 in FIG. 15) may be attached between the joint surfaces. The heat transfer grease 137 or heat conductive sheet preferably has a thermal conductivity of 0.8 W/mK or greater. Such a configuration can obtain good heat transfer efficiency in the joint surfaces at which the cooling surface member 140 and the heat exchanging member 120 are indirectly joined, thus enhancing the effect of cooling the sheet P.

In addition, when the cooling surface member 140 is plated, the heat transfer grease 137 or the heat conductive sheet is preferably insulative. When a layer filling between a metal plate layer of the joint surface 143 of the cooling surface member 140 and an aluminum layer of the joint surface 123 of the heat exchanging member 120 is electrically conductive, such a configuration prevents occurrence of slight current in the layer, thus preventing galvanic corrosion. Accordingly, even when the cooling surface member 140 and the heat exchanging member 120 are formed of different types of metal or one of the joint surfaces 143 and 123 is processed by, e.g., plating, use of such an insulative material can suppress occurrence of galvanic corrosion which might be caused by a slight current between the joint surfaces 143 and 123. In such a case, the cooling surface member 140 and the heat exchanging member 120 are preferably connected to the ground.

Figure 5:
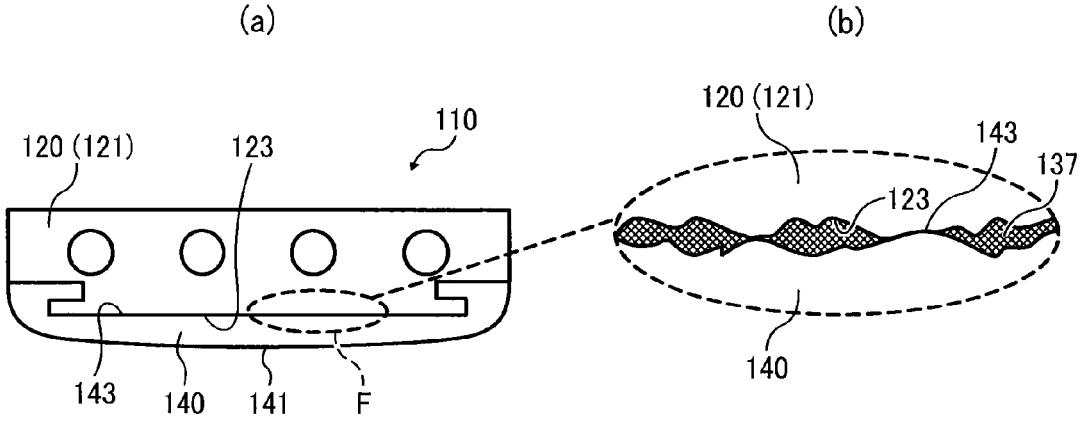
FIG. 5 is a schematic view of a joint portion of a heat exchanging member and a cooling surface member of the cooling member illustrated in FIG. 4.

In this embodiment, as illustrated in FIG. 5, the cooling surface 141 of the cooling surface member 140 is a curved surface having a constant curvature. In other words, at least a part of the cooling surface 141 of the cooling surface member 140 is a curved surface. Such a configuration allows a tension applied to the front-side endless belt 161 or the back-side endless belt 171 to enhance adhesion between each of the front-side endless belt 161 and the back-side endless belt 171 and between each of the sheet P and the cooling surface 141 of the cooling surface member 140, thus enhancing the effect of cooling the sheet P. In this embodiment, when plural cooling members 110 are provided, setting the cooling surface 141 of the cooling surface member 140 to a constant curvature allows the cooling members 110 to be formed of common parts. Alternatively, the curvature of the cooling surface 141 is not limited to such a constant curvature but may be not constant.

Next, a cooling device 100 according to another embodiment of this disclosure is described below.

This embodiment differs from the above-described embodiments illustrated in FIGS. 3A through 3C, 4, and 5 in that a cooling surface member 140 of the cooling device 100 according to this embodiment is subjected to surface processing. Except for the difference, this embodiment is substantially the same as the above-described embodiments of FIGS. 3A through 5. Therefore, substantially the same configuration and action, and operation and effects thereof as the above-described embodiments of FIGS. 3A through 5 are omitted below as needed.

The cooling member 110 in this embodiment is the same as the cooling member 110 in the above-described embodiments of FIGS. 3A through 3C, 4, and 5, and a base material of the cooling member 110 is made of aluminum. However, a cooling surface member 140 having a cooling surface 141 to indirectly contact a sheet P via a front-side endless belt 161 and a back-side endless belt 171 is plated, as surface processing, with nickel having a higher hardness than aluminum of the base material. In such a case, the surface processing may be conducted on only the cooling surface 141. By contrast, the heat exchanging member 120 directly or indirectly jointed to the cooling surface member 140 is not subjected to such surface processing conducted on the cooling surface member 140. In other words, the cooling surface 141 of the cooling surface member 140 plated, as surface processing, with nickel having a higher hardness than aluminum of the base material has a higher hardness than the heat exchanging member 120 not subjected to surface processing.

Such a configuration can enhance wear resistance of the cooling surface 141 of the cooling surface member 140 to slidingly contact the front-side endless belt 161 or the back-side endless belt 171 and suppress wearing of the cooling surface 141, thus allowing the cooling surface 141 of the cooling surface member 140 to be maintained at good condition over a long period of time. In addition, unlike a single-piece configuration of the cooling member, such a configuration can limit a member or part having an enhanced wear resistance by surface processing to the cooling surface member 140 or the cooling surface 141, thus preventing deterioration due to extra surface processing to, e.g., the heat exchanging member 120 or a dimensional change due to film plating. Furthermore, such a configuration can reduce the volume or area of a plated portion, thus allowing an increased number of members to be plated simultaneously in a plating chamber or reducing materials consumed by plating. As a result, the cost of the cooling member 110 can be reduced and the productivity of the cooling member 110 can be increased.

The surface processing of the cooling surface member 140 is not limited to the above-described nickel plating. For example, as illustrated in Table 1, to enhance the wear resistance, the cooling surface member 140 may be plated with chromium having a higher hardness than the base material. Alternatively, the cooling surface member 140 may be surface processed with diamond-like carbon (DLC) or anodized aluminum.

TABLE 1

| High Hardness | Low friction coefficient | High thermal conductivity |
|---|---|---|
| Nickel plating<br>Chromium plating<br>Anodized aluminum<br>DLC etc. | PTFE<br>DLC<br>Nickel plating<br>Chromium plating<br>Copper plating etc. | Silver plating etc. |

Alternatively, to reduce friction coefficient, the cooling surface member 140 may be surface-processed to form a layer of polytetrafluoroethylene (PTFE) illustrated in Table 1. Such surface processing to the cooling surface 141 of the cooling surface member 140 can set a lower friction coefficient of the cooling surface 141 than a friction coefficient of the heat exchanging member 120.

Such a configuration can obtain smooth sliding performance of the front-side endless belt 161 or the back-side endless belt 171 to slide against the cooling surface 141 of the cooling surface member 140 and suppress damage to the front-side endless belt 161 and the back-side endless belt 171. As a result, load to a driving motor to drive the front-side endless belt 161 and the back-side endless belt 171 can be reduced, thus allowing energy saving. The member or part having a reduced friction coefficient by surface processing can be limited to the cooling surface 141 of the cooling surface member 140. Accordingly, such a configuration can reduce the volume or area of a surface-processed portion, thus allowing an increased number of members to be simultaneously surface-processed or reducing materials consumed by plating. As a result, the cost of the cooling member 110 can be reduced and the productivity of the cooling member 110 can be increased.

Alternatively, as a surface property applied to the cooling surface 141, thermal conductivity may be prioritized than the wear resistance. In such a case, the cooling surface 141 is surface-processed by, e.g., copper plating to obtain a highly conductive surface. Setting a higher thermal conductivity of the cooling surface 141 than the heat exchanging member 120 can increase heat absorption efficiency when the cooling surface 141 of the cooling surface member 140 contacts the front-side endless belt 161 and absorbs heat of a sheet P. In other words, such a configuration can enhance the cooling effect of cooling the sheet P with the cooling member 110.

Such a configuration also limits the member or part having a reduced friction coefficient by surface processing to the cooling surface 141 of the cooling surface member 140. Accordingly, such a configuration can reduce the volume or area of a surface-processed portion, thus allowing an increased number of members to be simultaneously surface-processed or reducing materials consumed by plating. As a result, the cost of the cooling member 110 can be reduced and the productivity of the cooling member 110 can be increased.

Next, a cooling device 100 according to another embodiment of this disclosure is described with reference to FIG. 6.

Figure 6:
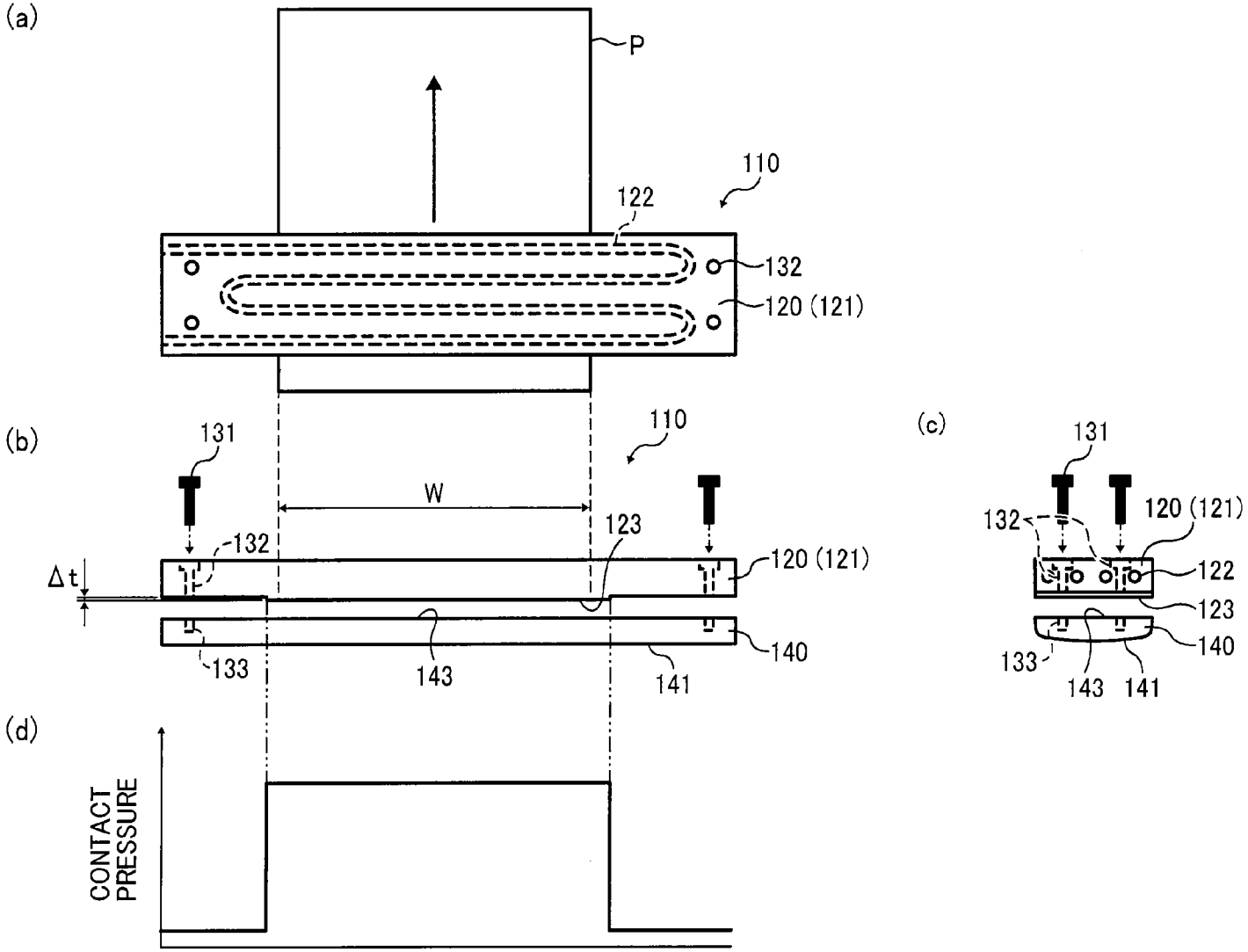
FIG. 6 is a schematic view of a cooling member according to an embodiment of this disclosure.

FIG. 6 is a schematic view of a cooling member 110 of the cooling device 100 in this embodiment. FIG. 6 includes (a) a plan view of an area (hereinafter also referred to as sheet passing area) of the cooling member 110 in which a sheet P passes through the cooling member 110, and (b) a cross sectional view of the sheet passing area of the cooling member 110 cut along a sheet width direction of the sheet P. FIG. 6 also includes (c) an elevation view of the sheet passing area of the cooling member 110 in a sheet transport direction in which the sheet P is transported to the cooling member 110, and (d) a chart of distribution of contact pressure at which a joint surface 143 of a cooling surface member 140 and a joint surface 123 of a heat exchanging member 120 contact each other.

Figure 7:
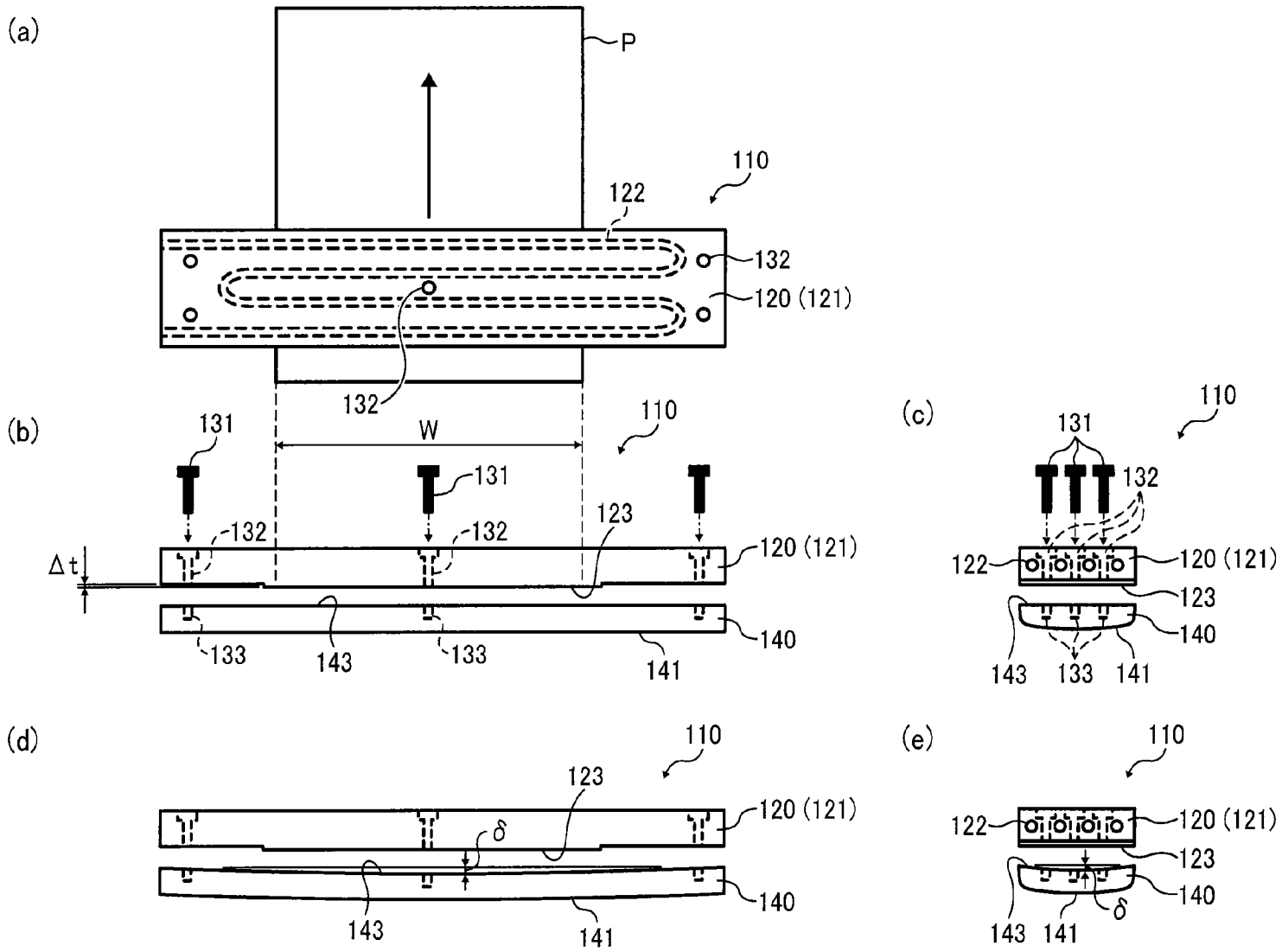
FIG. 7 is a schematic view of a variation of the cooling member illustrated in FIG. 6.

FIG. 7 is a schematic view of a cooling member 110 according to a variation 1 of this embodiment.

FIG. 7 includes (a) a plan view of an area (hereinafter also referred to as sheet passing area) of the cooling member 110 in which a sheet P passes through the cooling device 100 according to the variation 1 of this embodiment. FIG. 7 also includes (b) a cross sectional view of the sheet passing area of the cooling member 110 in the variation 1 cut along a sheet width direction of the sheet P, and (c) an elevation view of the sheet passing area of the cooling member 110 in the variation 1 in the sheet transport direction. FIG. 7 further includes (d) a cross sectional view of an example in which, in the variation 1, a substantially middle portion of a joint surface 143 of a cooling surface member 140 in the sheet width direction deforms away from a joint surface 123 of a heat exchanging member 120. FIG. 7 further includes (e) an elevation view of the example of (d) of FIG. 7 in the sheet transport direction.

This embodiment differs from the above-described embodiments illustrated in FIGS. 3A through 3C, 4, and 5 in the following points. For example, the cooling member 110 according to this embodiment has a configuration of enhancing the contact pressure at which the joint surface 143 of the cooling surface member 140 and the joint surface 123 of the heat exchanging member 120 contact each other in the sheet passing area. In addition, in this embodiment, a method of fastening the cooling surface member 140 and the heat exchanging member 120 with screws is defined. Except for the different points, this embodiment is substantially the same as the above-described embodiments of FIGS. 3A through 5. Therefore, substantially the same configuration and action, and operation and effects thereof as the above-described embodiments of FIGS. 3A through 5 are omitted below as needed.

In this embodiment, a configuration is employed to enhance the contact pressure between the joint surface 143 of the cooling surface member 140 and the joint surface 123 of the heat exchanging member 120 in the sheet passing area illustrated in (a) of FIG. 6, in other words, an area across a maximum sheet passing width W of a sheet P transported. For the cooling member 110 in this embodiment, as illustrated in (b) of FIG. 6, the cooling surface member 140 and the heat exchanging member 120 are fastened with two screws 131 at positions near both ends in the sheet width direction and outside the maximum sheet passing width W of the sheet P. The joint surface 123 of the heat exchanging member 120 has a convex portion protruding toward the joint surface 143 of the cooling surface member 140. The convex portion protrudes toward the joint surface 143 of the cooling surface member 140 beyond surface areas of the heat exchanging member 120 (heat exchanging base member 121) near both ends of the sheet P by a distance Δt and has a slightly greater width in the sheet width direction than the maximum sheet passing width W.

As illustrated in (d) of FIG. 6. such a configuration allows the contact pressure between the joint surface 143 of the cooling surface member 140 and the joint surface 123 of the heat exchanging member 120 to be concentrated on a sheet passing portion corresponding to the sheet passing area. As a result, adhesion between the joint surface 143 of the cooling surface member 140 and the joint surface 123 of the heat exchanging member 120 can be enhanced, thus allowing enhancement of heat transfer efficiency in the sheet passing portion. In a case in which heat transfer grease 137 is applied to between the heat exchanging member 120 and the cooling surface member 140, cracks formed in areas near both ends and outside the sheet passing area serve as escapes for surplus of the heat transfer grease 137. Such a configuration can suppress a reduction in thermal conductivity due to accumulation of an excessive thickness of the heat transfer grease 137 at the sheet passing portion.

Here, in the above-described example, as illustrated in (a) through (c) of FIG. 6, the heat exchanging member 120 and the cooling surface member 140 are fastened with the screws 131 at the positions near both ends thereof and outside the maximum sheet passing width W of the sheet P. However, the configuration of the heat exchanging member 120 and the cooling surface member 140 is not limited to the above-described configuration but may be configured as in, for example, the following variation 1. For example, as illustrated in (d) of FIG. 7, if a substantially middle portion of the joint surface 143 of the cooling surface member 140 in the sheet width direction deforms away from the joint surface 123 of the heat exchanging member 120 by a distance 6, the following failure might occur. As described with reference to FIG. 6, when the heat exchanging member 120 and the cooling surface member 140 are fastened with the two screws 131 at only the positions near both ends thereof, a clearance might be created between substantially middle portions of the heat exchanging member 120 and the cooling surface member 140. As a result, heat transfer efficiency might extremely decrease. For example, in a case in which the heat transfer grease 137 is applied, the thickness of the heat transfer grease 137 might excessively increase between the substantially middle portions of the heat exchanging member 120 and the cooling surface member 140, thus reducing heat transfer efficiency between the substantially middle portions. In addition, as illustrated in (e) of FIG. 7, a substantially middle portion of the joint surface 143 of the cooling surface member 140 in the sheet transport direction deforms away from the joint surface 123 of the heat exchanging member 120, a similar failure might occur.

Hence, for the cooling member 110 in this variation 1, as illustrated in (a) through (c) of FIG. 7, the cooling surface member 140 and the heat exchanging member 120 are fastened with another screw 131 at a substantially center in the sheet width direction and the sheet transport direction within the maximum sheet passing width W, besides the positions near both ends thereof in the sheet width direction of the sheet P. As described above, by fastening the substantially center of the cooling member 110 with another screw 131, a clearance due to the deformation δ of the joint surface 143 of the cooling surface member 140 can be reduced by the fastening force of the another screw 131, thus suppressing the above-described failure.

Next, a cooling device 100 according to another embodiment of this disclosure is described with reference to FIG. 8.

Figure 8:
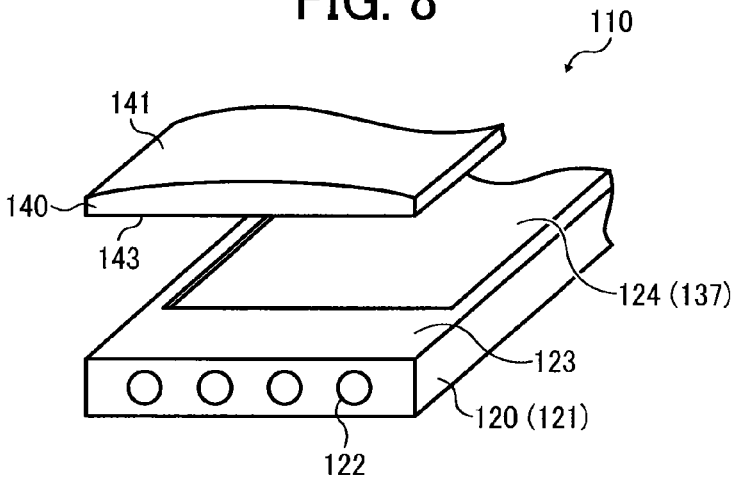
FIG. 8 is a schematic view of joint surfaces of a heat exchanging member and a cooling surface member of a cooling member according to an embodiment of this disclosure.
Figure 9A:
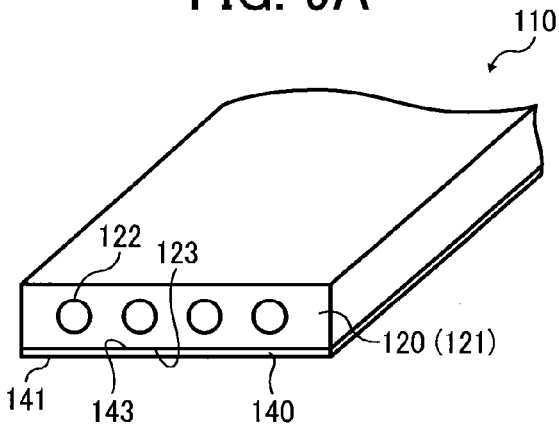
FIG. 9A is a schematic view of an example of a configuration of the cooling member illustrated in FIG. 8.
Figure 9B:
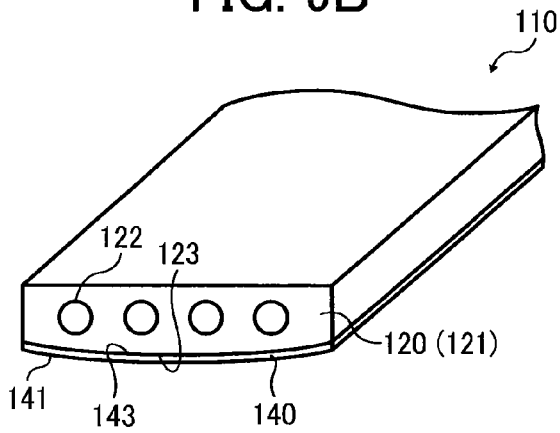
FIG. 9B is a schematic view of another example of a configuration of the cooling member illustrated in FIG. 8.

FIG. 8 is a schematic view of a joint surface 143 of a cooling surface member 140 and a joint surface 123 of a heat exchanging member 120 in the cooling member 110 in this embodiment. FIGS. 9A and 9B are schematic views of different examples of the cooling member 110 in this embodiment. FIG. 9A is a schematic view of an example of the cooling member 110 in which each of joint surfaces 143 and 123 of a cooling surface member 140 and a heat exchanging member 120 has a flat shape and a sheet-type cooling surface member 140 is employed. FIG. 9B is a schematic view of an example of the cooling member 110 in which a joint surface 123 of a heat exchanging member 120 has a curved shape and a sheet-type cooling surface member 140 is disposed to curve along the curved shape of the joint surface 123 of the heat exchanging member 120.

This embodiment differs from the above-described embodiments illustrated in FIGS. 3A through 7 in the shapes of a cooling surface member 140 and a heat exchanging member 120 of a cooling member 110. Except for the different points, this embodiment is substantially the same as the above-described embodiments of FIGS. 3A through 7. Therefore, substantially the same configuration and action, and operation and effects thereof as the above-described embodiments of FIGS. 3A through 7 are omitted below as needed.

As described in the above-described embodiment illustrated in FIGS. 6 and 7, in a case in which heat transfer grease 137 is applied between a joint surface 143 of the cooling surface member 140 and a joint surface 123 of the heat exchanging member 120, the heat transfer grease 137 is preferably applied to be uniform and thin. Hence, in this embodiment, the joint surface 123 of the heat exchanging member 120 has a configuration to adjust the application amount of the heat transfer grease 137 applied between the joint surface 143 of the cooling surface member 140 and the joint surface 123 of the heat exchanging member 120 and maintain a substantially constant and less variable performance in mass production. For example, the joint surface 123 of the heat exchanging member 120 has a recessed portion 124 illustrated in FIG. 8 to accurately adjust the thickness, in other words, application amount and position of the heat transfer grease 137 when the heat exchanging member 120 and the cooling surface member 140 are joined together. Alternatively, the recessed portion 124 illustrated in FIG. 8 may be disposed at the joint surface 143 of the cooling surface member 140.

In the examples illustrated in FIGS. 3A through 8, as the cross-sectional shape of the cooling surface member 140 in the sheet transport direction, the joint surface 143 has a flat shape and the cooling surface 141 partially has a curved surface. However, the configuration of the cooling surface member 140 is not limited to the above-described configuration. For example, as illustrated in FIG. 9A, each of the joint surface 143 of the cooling surface member 140 and the joint surface 123 of the heat exchanging member 120 can be a flat shape and the cooling surface member 140 can also have a flat shape. In addition, as illustrated in FIG. 9B, the joint surface 123 of the heat exchanging member 120 can have a curved shape, and the sheet-type cooling surface member 140 can be joined so as to follow the curved shape of the joint surface 123. As described above, by using a sheet member as the cooling surface member 140, when the heat exchanging member 120 is made of aluminum, the cooling surface member 140 can be formed of a steel plate having a higher hardness than aluminum, thus further enhancing wear resistance of the cooling surface 141.

Next, a cooling device 100 according to another embodiment of this disclosure is described with reference to FIG. 10.

Figure 10:
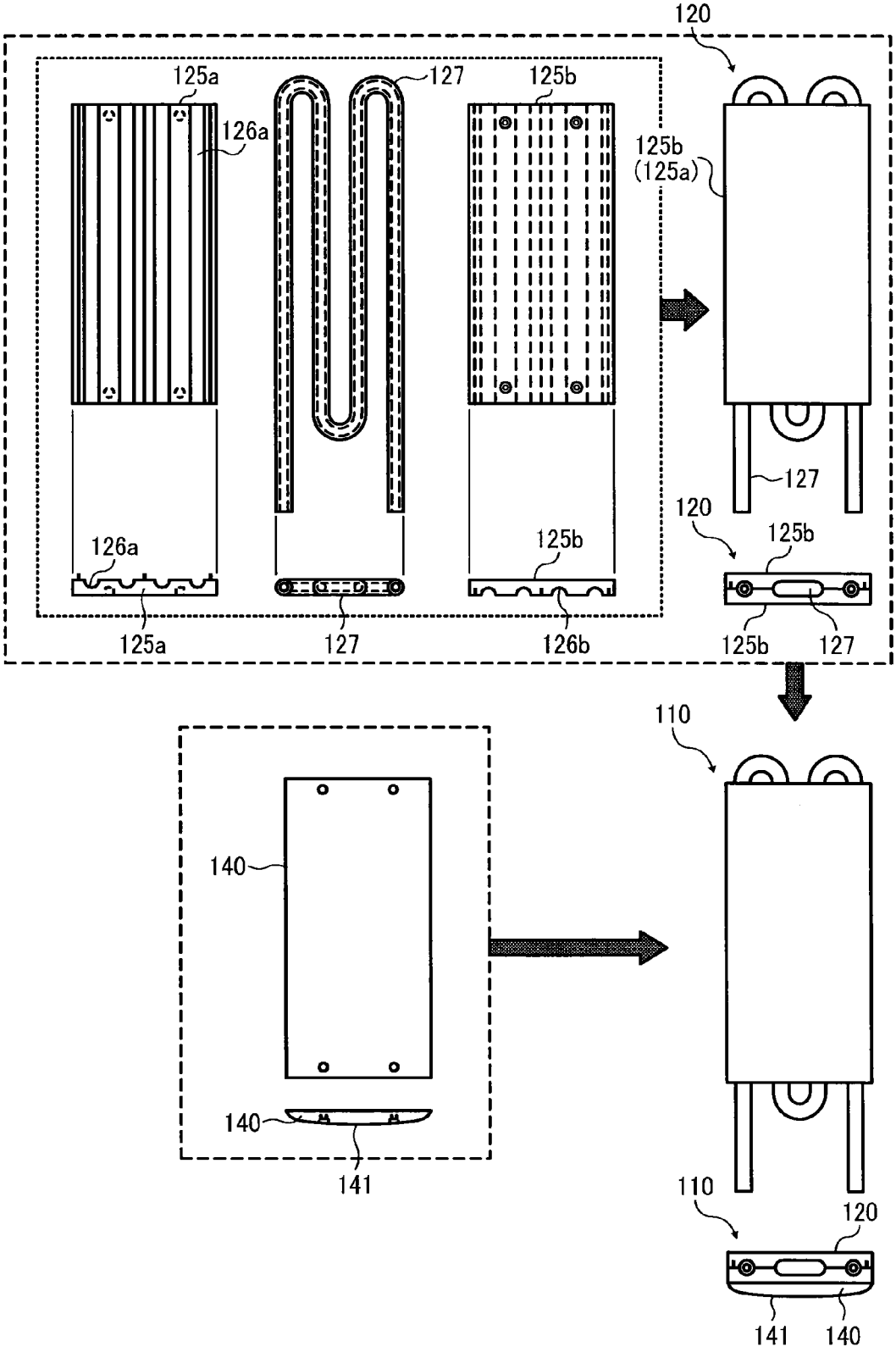
FIG. 10 is a schematic view of an example of members constituting a cooling member according to an embodiment of this disclosure and an example of a method of producing the cooling member.

FIG. 10 is a schematic view of parts constituting a cooling member 110 of the cooling device 100 in this embodiment and an example of a method of producing the cooling member 110. This embodiment differs from the above-described embodiments illustrated in FIGS. 3A through 7 with respect to the parts constituting the cooling member 110 and the production method illustrated in FIG. 10. For example, parts constituting a heat exchanging member 120 and a method of producing the heat exchanging member 120 are different between this embodiment and the above-described embodiments illustrated in FIGS. 3A through 7. Except for the different points, this embodiment is substantially the same as the above-described embodiments of FIGS. 3A through 7. Therefore, substantially the same configuration and action, and operation and effects thereof as the above-described embodiments of FIGS. 3A through 7 are omitted below as needed.

As illustrated in FIG. 10, the cooling member 110 in this embodiment includes a cooling surface member 140 having a cooling surface 141 to slidingly contact, e.g., a front-side endless belt 161 and the heat exchanging member 120 having a flow channel for cooling liquid. The heat exchanging member 120 includes a copper pipe 127, a heat exchanging part 125*a*, and a heat exchanging part 125*b*. The copper pipe 127 has three bent portions forming the flow channel for the cooling liquid. The heat exchanging part 125*a* sandwiches the copper pipe 127 from a side proximal to the cooling surface member 140. The heat exchanging part 125*b* sandwiches the copper pipe 127 from a side distal to the cooling surface member 140. The copper pipe 127 is a tubular member having the three bent portions and four straight portions parallel to the sheet width direction and forms a single continuous channel for the cooling liquid. At one end of the heat exchanging part 125*a* and the heat exchanging part 125*b* in the sheet width direction, openings of the copper pipe 127 at a first straight portion of the straight portions at a most downstream side and a fourth straight portion of the straight portions at a most upstream side in the sheet transport direction are communicated to the outside of the heat exchanging member 120.

The heat exchanging part 125*a* and the heat exchanging part 125*b* have a groove portion 126*a* and a groove portion 126*b*, respectively, serving as grooves to sandwich the copper pipe 127. With the copper pipe 127 sandwiched by the groove portion 126*a* and the groove portion 126*b*, the groove portion 126*a* and the groove portion 126*b* are united by swaging to form the heat exchanging member 120. Here, the material of each of the heat exchanging part 125*a* and the heat exchanging part 125*b* to sandwich the copper pipe 127 is not limited to aluminum but any of the heat exchanging part 125*a* and the heat exchanging part 125*b* is made of metal. As a method of producing the heat exchanging part 125*a* and the heat exchanging part 125*b*, for example, a molding member using a mold for forming a swaged portion as a single piece or an extrusion member to form a member for fastening the cooling surface member 140 with the heat exchanging member 120 in post processing may be employed.

The cooling surface member 140 is an aluminum extrusion member having a curved surface. The heat exchanging member 120 and the cooling surface member 140 thus produced are fixed by screw fastening to form the cooling member 110. The copper pipe 127 is connected to a rubber tube 184 of an external radiator 180 to form a circulation channel of cooling liquid according to a liquid cooling system.

Here, if the cooling surface 141 is formed directly in the heat exchanging part 125*a* to slidingly contact, e.g., the front-side endless belt 161, the curved shape of the cooling surface 141 might be deformed by stress in the swaging process. Alternatively, the cooling surface 141 might be damaged in other processing. Such deformation of the curved shape or damage to the cooling surface 141 might require additional surface processing by machining to mend deformation or damage, thus resulting in a cost increase. By contrast, for the cooling member 110 in this embodiment, as described above, the heat exchanging member 120 and the cooling surface member 140 can be separately produced. Such a configuration can suppress occurrence of deformation and damage and prevent a cost increase due to additional surface processing by machining to mend the deformation or damage.

Next, a cooling device 100 according to another embodiment of this disclosure is described with reference to FIG. 11.

Figure 11:
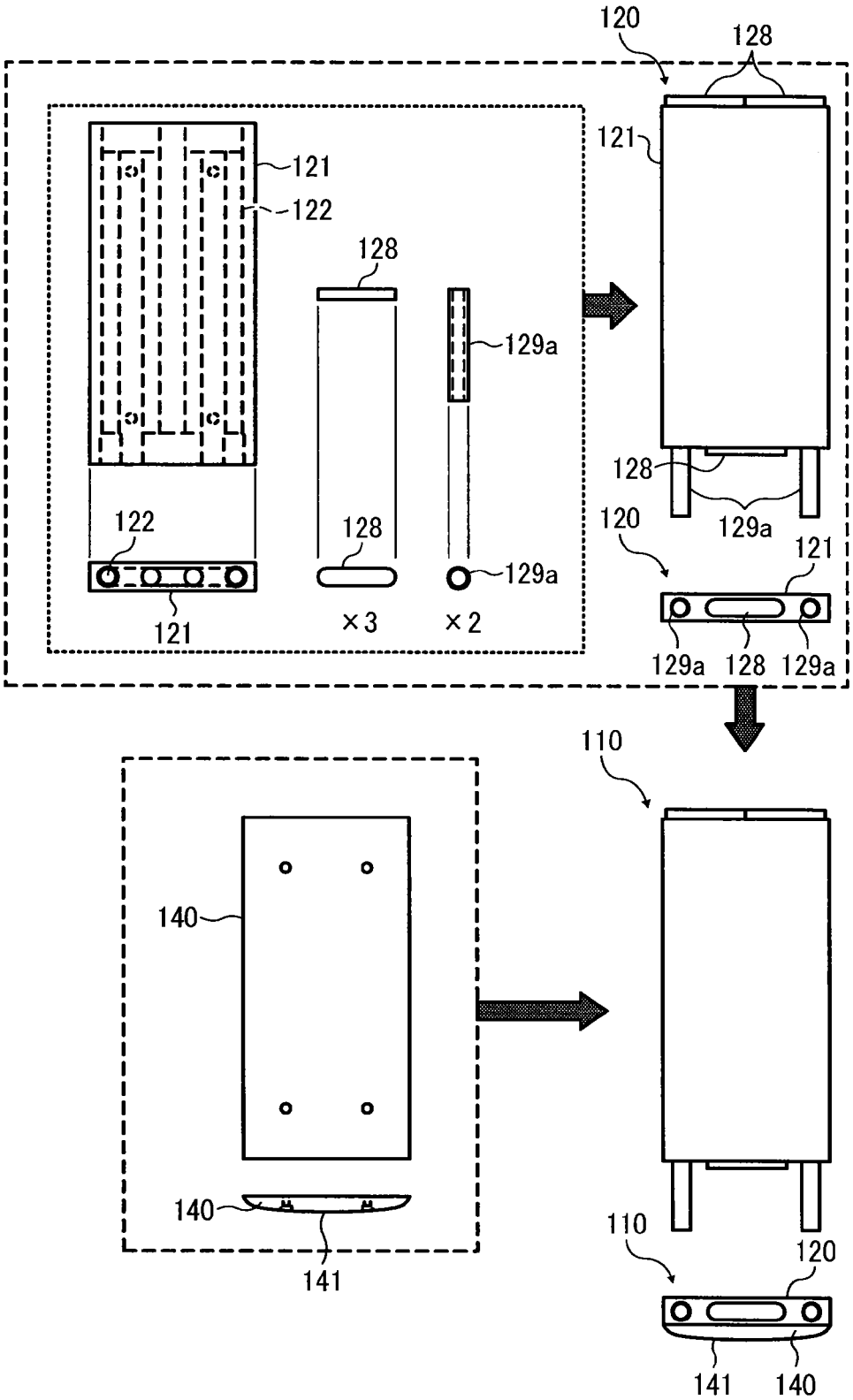
FIG. 11 is a schematic view of an example of members constituting a cooling member according to an embodiment of this disclosure and an example of a method of producing the cooling member.

FIG. 11 is a schematic view of parts constituting a cooling member 110 of the cooling device 100 in this embodiment and an example of a method of producing the cooling member 110. This embodiment differs from the above-described embodiment illustrated in FIG. 10 with respect to parts constituting a heat exchanging member 120 of the cooling member 110 and a production method of the heat exchanging member 120. Except for the different points, this embodiment is substantially the same as the above-described embodiment of FIG. 10. Therefore, substantially the same configuration and action, and operation and effects thereof as the above-described embodiment of FIG. 10 are omitted below as needed.

As illustrated in FIG. 11, the cooling member 110 in this embodiment includes a cooling surface member 140 having a cooling surface 141 to slidingly contact, e.g., a front-side endless belt 161 and the heat exchanging member 120 having a flow channel 122 for cooling liquid. The heat exchanging member 120 includes a heat exchanging base member 121, sealing members 128, and tubular connection members 129*a*. The heat exchanging base member 121 has plural holes constituting the flow channel 122. The sealing members 128 constitute folded portions of the flow channel 122. The connection members 129*a* connect a rubber tube 184 of an external radiator 180 and the flow channel 122.

The heat exchanging base member 121 has four through-holes passing through the heat exchanging base member 121 in a sheet width direction of a sheet P. The though holes have a circular cross section and are formed in parallel to each other from a downstream side toward an upstream side in a transport direction of the sheet P. At an end of each of a second through-hole adjacent to a first through-hole of the through-holes at a most downstream side and a fourth through-hole at a most upstream side adjacent to a third through-hole from the most downstream side, a groove-shaped folded portion connecting adjacent ones of the through-holes is formed at a certain depth from an edge of the end. At the opposite end of each of the second through-hole and the third through-hole from the most downstream side of the though holes, a groove-shaped folded portion is formed at a certain depth from an edge of the opposite end. Each of the first through-hole at the most downstream side and the fourth through-hole at the most upstream side is formed to have a slightly larger diameter at the opposite end than at any other portion so that the tubular connection members 129*a* are fitted into the first through-hole and the fourth through-hole.

Three folded portions formed in the heat exchanging base member 121 are sealed with first to third ones of the sealing members 128 from an open end side to form the flow channel 122 as a single continuous channel. As described above, each of the two connection members 129*a* is connected to the opposite end of each of the first through-hole at the most downstream side and the forth through-hole at the most upstream side. Here, each of the above-described components is made of metal. The sealing member 128 and the connection members 129*a* are joined to the heat exchanging base member 121 by, e.g., adhesion or brazing to form a single piece. Then, the flow channel 122 for cooling liquid is closed to form the heat exchanging member 120. Alternatively, instead of adhesion or brazing, a method may be employed of covering an interface between components with a mold and ejecting resin to the mold to unite the components (hereinafter, resin integrated molding; for example, a nano molding technology of Taiseiplas Co., Ltd.). As a method of producing the heat exchanging base member 121, alternatively, after a base material is drilled by, e.g., a lathe or casted with a mold to form rough holes, an inner circumferential surface of each hole is drilled by, e.g., a lathe in post processing to have a desired shape or a member for fastening the cooling surface member 140 may be formed.

The cooling surface member 140 is an aluminum extrusion member having a curved surface. The heat exchanging member 120 and the cooling surface member 140 thus produced are fixed by screw fastening to form the cooling member 110. The copper pipe 127 is connected to a rubber tube 184 of an external radiator 180 to form a circulation channel of cooling liquid according to a liquid cooling system.

Here, in a case in which the cooling surface 141 is directly formed in the heat exchanging base member 121 of the cooling member 110, for example, the following failure might occur when the cooling surface 141 is surface processed to enhance wear resistance. For example, if surface processing for providing a high degree of releasability is conducted on the cooling surface 141 before the above-described sealing members 128 or the connection members 129*a* are joined to the heat exchanging base member 121, for example, the sealing members 128 might not properly adhere to the surface-processed cooling surface 141 by adhesive. If surface processing is conducted on the cooling surface 141 after the above-described sealing members 128 or the connection members 129*a* are joined to the heat exchanging base member 121, it is conceivable to adhere the sealing members 128 to the cooling surface 141 by, e.g., adhesive and soak the cooling surface 141 in a chemical solution for plating or other surface processing. However, in such a case, the chemical solution might erode and degrade adhering portions between the sealing members 128 and the cooling surface 141. Here, masking the adhering portions of the sealing members 128 during surface processing can prevent the above-described problem but might increase the production cost.

By contrast, for the cooling member 110 in this embodiment, as described above, the heat exchanging member 120 and the cooling surface member 140 can be separately produced. Accordingly, post-processing, such as a desired surface processing, is conducted on the cooling surface member 140, and then the cooling surface member 140 can be joined to the heat exchanging member 120. Such a configuration can prevent a failure or cost increase due to the above-described surface processing.

Next, a cooling device 100 according to another embodiment of this disclosure is described with reference to FIG. 12.

Figure 12:
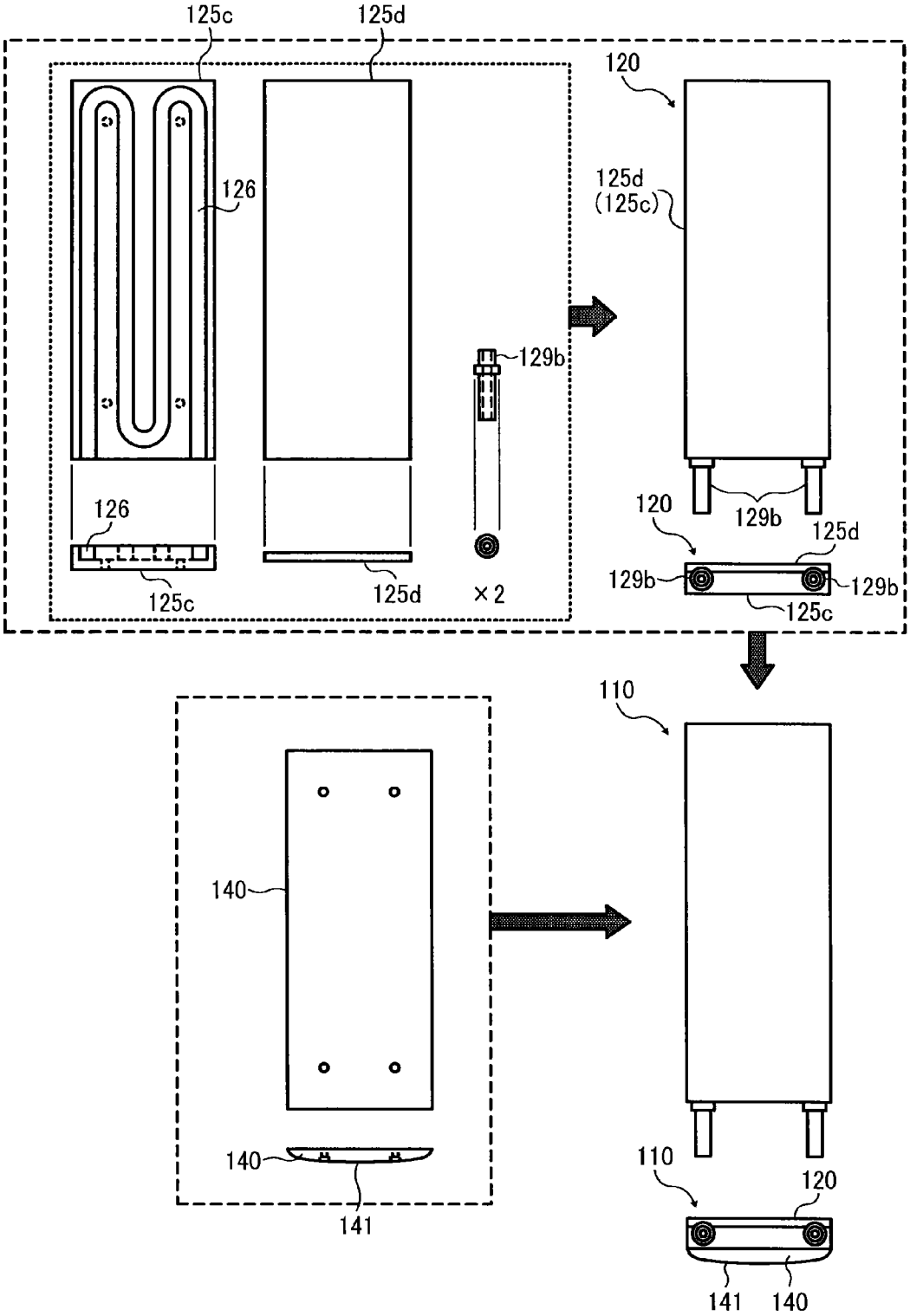
FIG. 12 is a schematic view of an example of members constituting a cooling member according to an embodiment of this disclosure and an example of a method of producing the cooling member.

FIG. 12 is a schematic view of parts constituting a cooling member 110 of the cooling device 100 in this embodiment and an example of a method of producing the cooling member 110. This embodiment differs from the above-described embodiment illustrated in FIGS. 10 and 11 with respect to parts constituting a heat exchanging member 120 of the cooling member 110 and a production method of the heat exchanging member 120. Except for the difference, this embodiment is substantially the same as the above-described embodiments of FIGS. 10 and 11. Therefore, substantially the same configuration and action, and operation and effects thereof as the above-described embodiments of FIGS. 10 and 11 are omitted below as needed.

As illustrated in FIG. 12, the cooling member 110 in this embodiment includes a cooling surface member 140 having a cooling surface 141 to slidingly contact, e.g., a front-side endless belt 161 and the heat exchanging member 120 having a flow channel for cooling liquid. The heat exchanging member 120 includes a heat exchanging part 125*c*, a heat exchanging part 125*d*, and tubular connection members 129*b*. The heat exchanging part 125*c* includes a groove portion 126 constituting a flow channel. The heat exchanging part 125*d* has a flat shape to cover the groove portion 126. The connection members 129*b* connect a rubber tube 184 of an external radiator 180 and the flow channel 122.

The groove portion 126 of the heat exchanging part 125*c* is a single, continuous groove forming a flow channel for cooling liquid and has a rectangular shape including three bent portions and four straight portions parallel to the sheet width direction. The groove portion 126 is exposed at a side of the heat exchanging part 125*c* to which the cooling surface member 140 is not joined. At one end of the heat exchanging part 125*c* in the sheet width direction, an end of each of a first straight portion at a most downstream side and a fourth straight portion a most upstream side of the straight portions of the groove portion 126 in the sheet transport direction is communicated to the outside of the heat exchanging member 120. The tubular connection members 129*b* integrally molded with rectangular sealing portions are mounted at two points to the ends of the first straight portion and the forth straight portion of the groove portion 126. With the tubular connection members 129*b* mounted at the two points to the ends of the groove portion 126 of the heat exchanging part 125*c*, the side at which the groove portion 126 is exposed in the heat exchanging part 125*c* is covered with the flat-shaped heat exchanging part 125*d*, so that the heat exchanging part 125*c* and the heat exchanging part 125*d* join together.

Here, each of the above-described members is made of metal. Similarly with the above-described embodiment illustrated in FIG. 11, the heat exchanging part 125*d* and the tubular connection members 129*b* are joined to the heat exchanging part 125*c* by, e.g., adhesion or brazing to form a single piece. Then, the flow channel for cooling liquid is closed to form the heat exchanging member 120. As a method of producing the heat exchanging part 125*c*, alternatively, after a base material is drilled by, e.g., a lathe or casted with a mold to form rough holes, an inner circumferential surface of each hole is drilled by, e.g., a lathe in post processing to have a desired shape or a member for fastening the cooling surface member 140 may be formed.

The cooling surface member 140 is an aluminum extrusion member having a curved surface. The heat exchanging member 120 and the cooling surface member 140 thus produced are fixed by screw fastening to form the cooling member 110. The copper pipe 127 is connected to a rubber tube 184 of an external radiator 180 to form a circulation channel of cooling liquid according to a liquid cooling system. The cooling member 110 having such a configuration gives operation and effects equivalent to those of, e.g., the cooling member 110 in the above-described embodiment illustrated in FIG. 10.

Next, a cooling device 100 according to another embodiment of this disclosure is described with reference to FIG. 13.

Figure 13:
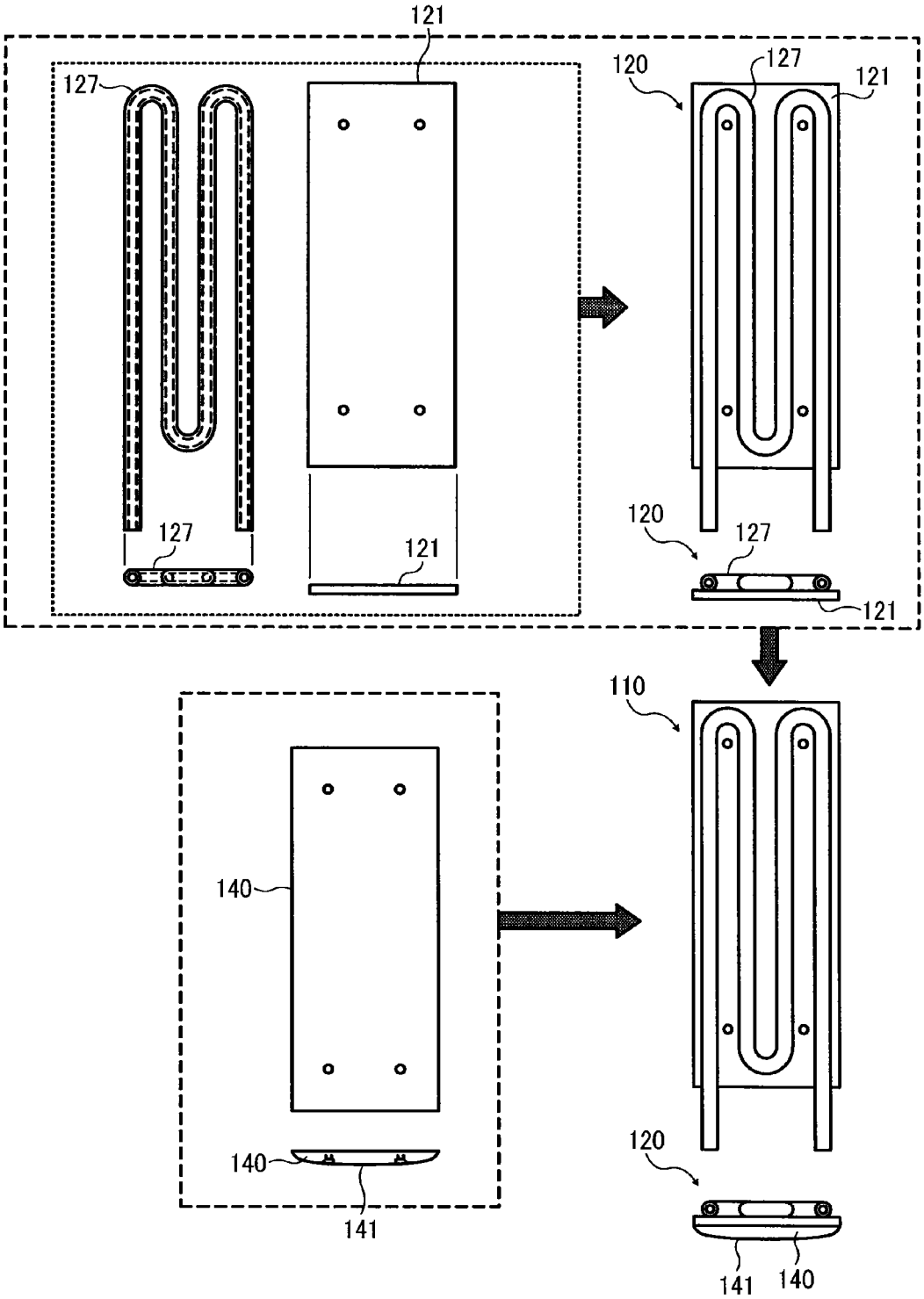
FIG. 13 is a schematic view of an example of members constituting a cooling member according to an embodiment of this disclosure and an example of a method of producing the cooling member.

FIG. 13 is a schematic view of parts constituting a cooling member 110 of the cooling device 100 in this embodiment and an example of a method of producing the cooling member 110. This embodiment differs from the above-described embodiment illustrated in FIGS. 10 through 12 with respect to parts constituting a heat exchanging member 120 of the cooling member 110 and a production method of the heat exchanging member 120. Except for the different points, this embodiment is substantially the same as the above-described embodiments of FIGS. 10 through 12. Therefore, substantially the same configuration and action, and operation and effects thereof as the above-described embodiments of FIGS. 10 through 12 are omitted below as needed.

As illustrated in FIG. 13, the cooling member 110 in this embodiment includes a cooling surface member 140 having a cooling surface 141 to slidingly contact, e.g., a front-side endless belt 161 and the heat exchanging member 120 having a flow channel for cooling liquid. The heat exchanging member 120 includes a copper pipe 127 and a heat exchanging base member 121. The copper pipe 127 forms the flow channel for cooling liquid. The heat exchanging base member 121 is a sheet metal member. The copper pipe 127 is mounted on a first surface of the heat exchanging base member 121. The cooling surface member 140 is joined to a second surface opposite the first surface of the heat exchanging base member 121. The copper pipe 127 is a tubular member having the three bent portions and four straight portions parallel to the sheet width direction and forms a single continuous channel for the cooling liquid. At one end of the heat exchanging base member 121 in the sheet width direction, an opening of each of a first straight portion at a most downstream side and a fourth straight portion at a most upstream side of four straight portions of the copper pipe 127 in the sheet transport direction is communicated to the outside of the heat exchanging base member 121.

As described above, the heat exchanging base member 121 is a sheet metal member mounting the copper pipe 127 on the second surface opposite the first surface on which the cooling surface member 140 is joined. The material of the heat exchanging base member 121 is not limited to aluminum but is metal. As a method of producing the heat exchanging base member 121, for example, a ready-made sheet metal member having a desire thickness may be post-processed to have a part for fastening the cooling surface member 140. The copper pipe 127 is joined to the heat exchanging base member 121 by an adhesive having a relatively high thermal conductivity or brazing to form the heat exchanging member 120 as a single piece.

The cooling surface member 140 is an aluminum extrusion member having a curved surface. The heat exchanging member 120 and the cooling surface member 140 thus produced are fixed by screw fastening to form the cooling member 110. The copper pipe 127 is connected to a rubber tube 184 of an external radiator 180 to form a circulation channel of cooling liquid according to a liquid cooling system.

Here, in a case in which the cooling surface 141 is directly formed in the heat exchanging base member 121 of the cooling member 110 or the heat exchanging base member 121 is processed by bending to have a curved surface, for example, the curved surface might deform due to heat generated by brazing, thus hampering retaining of a desired curved-surface shape. By contrast, for the cooling member 110 in this embodiment, as described above, the heat exchanging member 120 and the cooling surface member 140 can be separately produced. Accordingly, if the cooling surface member 140 is removed during brazing, heat would not affect the cooling surface member 140. As a result, with a desired shape of the cooling surface member 140 maintained, the cooling surface member 140 can be joined to the heat exchanging member 120.

Next, a cooling device 100 according to another embodiment of this disclosure is described with reference to FIG. 14.

Figure 14:
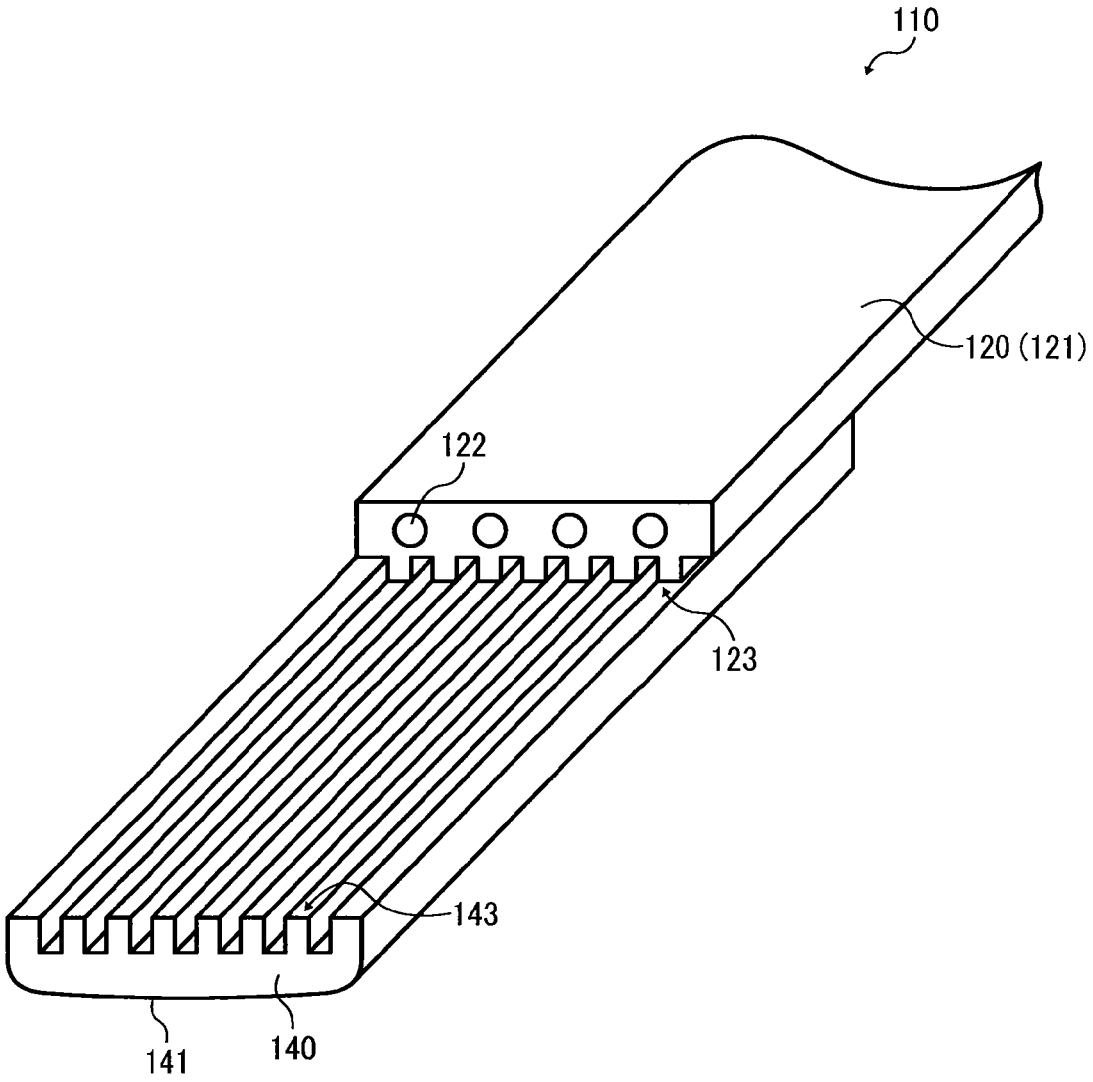
FIG. 14 is a schematic view of an example of a method of joining a cooling surface member and a heat exchanging member of a cooling member according to an embodiment of this disclosure.

FIG. 14 is a schematic view of an example of a method of joining a cooling surface member 140 and a heat exchanging member 120 of a cooling member 110 in this embodiment. This embodiment differs from the above-described embodiments illustrated in FIGS. 3A through 13 in the method of joining the cooling surface member 140 and the heat exchanging member 120 of the cooling member 110. Except for the different points, this embodiment is substantially the same as the above-described embodiments of FIGS. 3A through 13. Therefore, substantially the same configuration and action, and operation and effects thereof as the above-described embodiments of FIGS. 3A through 13 are omitted below as needed.

As illustrated in FIG. 14, the cooling member 110 in this embodiment includes a cooling surface member 140 having a cooling surface 141 to slidingly contact, e.g., a front-side endless belt 161 and a heat exchanging member 120 having a flow channel 122 for cooling liquid. The cooling surface member 140 absorbs heat from a target which the cooling surface 141 contacts, and transfers heat to the heat exchanging member 120 (heat exchanging base member 121) via a joint surface 143. Accordingly, the cooling surface member 140 and the heat exchanging member 120 preferably contact each other across a larger area.

Hence, for the cooling member 110 in this embodiment, the joint surface 143 of the cooling surface member 140 and the joint surface 123 of the heat exchanging member 120 have asperities, not flat shapes, to engage each other, thus increasing the contact area. Such an increased contact area can enhance the transfer efficiency of heat from the cooling surface member 140 to the heat exchanging member 120. In addition, for example, a heat transfer grease 137 having thermal conductivity may be applied between the cooling surface member 140 and the heat exchanging member 120 to further enhance the heat transfer efficiency. As a secondary effect, such a configuration also facilitates positioning of the cooling surface member 140 and the heat exchanging member 120 in assembly. In FIG. 14, after positioning of the cooling surface member 140 and the heat exchanging member 120 is performed, the cooling surface member 140 and the heat exchanging member 120 may be fastened with fastening members as illustrated in FIG. 3A through 3C.

Next, a cooling device 100 according to another embodiment of this disclosure is described with reference to FIG. 15.

Figure 15:
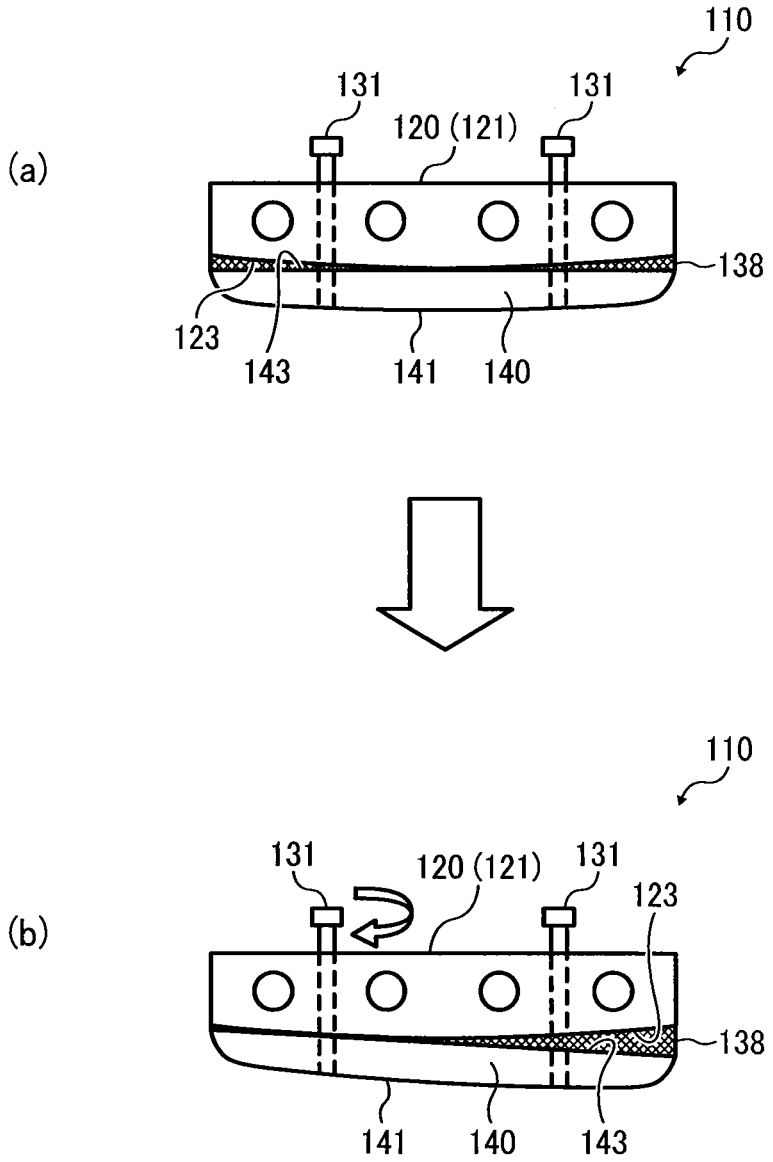
FIG. 15 is a schematic view of an example of a method of joining a cooling surface member and a heat exchanging member of a cooling member according to an embodiment of this disclosure.

FIG. 15 is a schematic view of an example of a method of joining a cooling surface member 140 and a heat exchanging member 120 of a cooling member 110 in this embodiment. In (a) of FIG. 15, two screws 131 serving as fastening members to fasten the cooling surface member 140 and the heat exchanging member 120 are disposed upstream and downstream from a center at an equal distance in the sheet transport direction. The cooling surface member 140 and the heat exchanging member 120 are substantially equally fastened with the two screws 131. In (b) of FIG. 15, two screws 131 serving as fastening members to fasten the cooling surface member 140 and the heat exchanging member 120 are also disposed upstream and downstream from a center at an equal distance in the sheet transport direction. However, the cooling surface member 140 and the heat exchanging member 120 are unevenly fastened with the two screws 131.

This embodiment differs from the above-described embodiments illustrated in FIGS. 3A through 14 in the method of joining the cooling surface member 140 and the heat exchanging member 120 of the cooling member 110. For example, this embodiment differs from the above-described embodiments illustrated in FIGS. 3A through 14 with respect to use of a configuration in which an angle of the cooling surface member 140 relative to the heat exchanging member 120 of the cooling member 110 is adjustable. Except for the different points, this embodiment is substantially the same as the above-described embodiments of FIGS. 3A through 14. Therefore, substantially the same configuration and action, and operation and effects thereof as the above-described embodiments of FIGS. 3A through 14 are omitted as needed.

As illustrated in (a) and (b) of FIG. 15, the cooling member 110 in this embodiment includes a cooling surface member 140 having a cooling surface 141 to slidingly contact, e.g., a front-side endless belt 161 and a heat exchanging member 120 having a flow channel 122 for cooling liquid. The cooling surface member 140 absorbs heat from the front-side endless belt 161 which the cooling surface 141 directly contacts or a sheet P, that is, a target which the cooling surface 141 indirectly contacts, and transfers heat to the heat exchanging member 120 (heat exchanging base member 121) via a joint surface 143. Accordingly, the cooling surface 141 preferably contacts the front-side endless belt 161 or the sheet P via the front-side endless belt 161 across a larger area. However, variations in the dimensions of component members of the cooling device 100 may cause errors in mounting the cooling member 110, thus resulting in an error in the angle of the cooling surface 141 relative to the front-side endless belt 161 or the sheet P. Such an error in the angle of the cooling surface 141 may create a clearance between the cooling surface 141 and each of the front-side endless belt 161 and the sheet P. As a result, the contact area between the cooling surface 141 and each of the front-side endless belt 161 and the sheet P may be reduced, thus resulting in a reduction in the cooling effect of cooling the sheet P.

If a typical configuration of cooling device is employed, an operator finds occurrence of an error in the angle of the cooling surface 141 relative to the front-side endless belt 161 or the sheet P after all component members of the cooling device are installed to an apparatus body 200 of an image forming apparatus 300 in production or maintenance. As described above, such an error of the angle of the cooling surface 141 is found after installation to the apparatus body 200, some component members of the cooling device 100 are removed to adjust the angle of the cooling surface 141, and installed again, thus significantly reducing the operability.

Hence, in the cooling device 100 according to this embodiment, the cooling member 110 has the following configuration. The joint surface 123 of the heat exchanging member 120 has a slight convex shape to contact the joint surface 143 of the cooling surface member 140 to fill the clearance between the heat exchanging member 120 and the cooling surface member 140 with, e.g., a heat conductive sheet 138 allowing elastic deformation. The heat exchanging member 120 and the cooling surface member 140 are joined together with the screws 131 for adjusting the angle of the cooling surface member 140. The mounting angle of the cooling surface 141 of the cooling surface member 140 is adjustable by changing the intensity of fastening of the screws 131. For example, in production or maintenance, as illustrated in (a) of FIG. 15, the heat exchanging member 120 and the cooling surface member 140 are joined together with the screws 131 so that the gap between the heat exchanging member 120 and the cooling surface member 140, in other words, the thickness of the heat conductive sheet 138 is substantially equal at an upstream end and a downstream end in the sheet transport direction. After mounting, as needed, for example, as illustrated in (b) of FIG. 15, one of the screws 131 for angle adjustment near the downstream end in the sheet transport direction is fastened to adjust so that the angle of the cooling surface 141 of the cooling surface member 140 becomes relatively narrow at the downstream end of the heat conductive sheet 138.

As described above, in this embodiment, the mounting angle of the cooling surface member 140 relative to the heat exchanging member 120 is configured to be adjustable, thus giving, e.g., the following effect. For example, even if variations in the dimensions of component members of the cooling device 100 cause errors in mounting the cooling member 110 and as a result, an error occurs in the angle of the cooling surface 141 relative to the front-side endless belt 161 or the sheet P, the angle is finely adjustable with only the cooling member 110. Accordingly, even after the cooling member 110 is mounted to the cooling device 100, the mounting angle of the cooling surface 141 is adjustable, thus enhancing the operability in assembling of the cooling device 100 or maintenance of the cooling surface 141.

Next, a cooling device 100 according to another embodiment of this disclosure is described with reference to FIG. 16.

Figure 16:
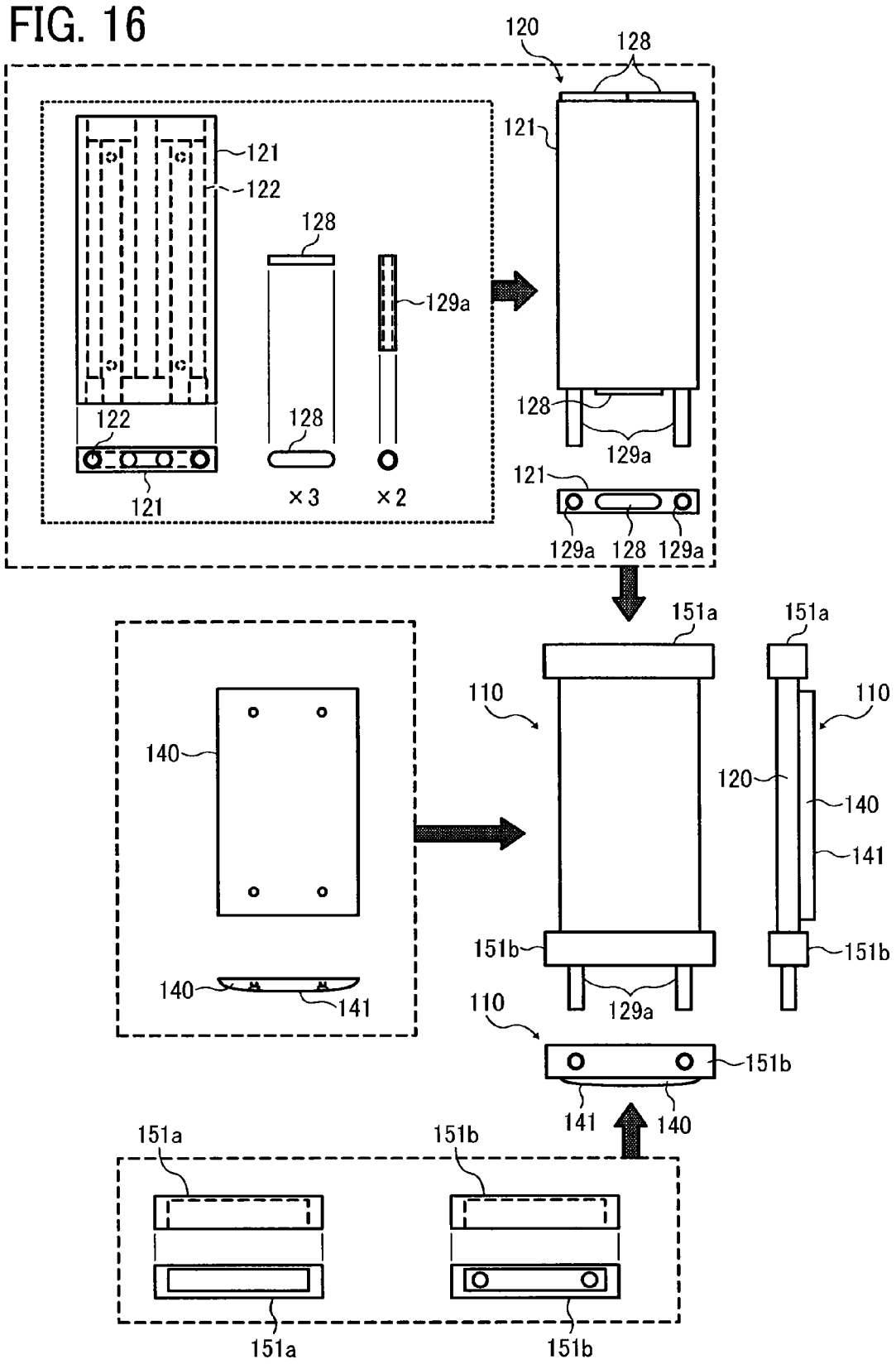
FIG. 16 is a schematic view of an example of members constituting a cooling member according to an embodiment of this disclosure and an example of a method of producing the cooling member.

FIG. 16 is a schematic view of parts constituting a cooling member 110 of the cooling device 100 in this embodiment and an example of a method of producing the cooling member 110. This embodiment differs from the above-described embodiments illustrated in FIGS. 3A through 15B in that caps 151*a* and 151*b* serving as cap members to cover ends of the heat exchanging member 120 are disposed at both ends in the sheet transport direction of the cooling member 110 in this embodiment. Except for the different points, this embodiment is substantially the same as the above-described embodiments of FIGS. 3A through 15B. Therefore, substantially the same configuration and action, and operation and effects thereof as the above-described embodiments of FIGS. 3A through 15B are omitted below as needed. In FIG. 16, the cooling member 110 in this embodiment has a basic configuration substantially the same as that of the above-described embodiment illustrated in FIG. 11.

As illustrated in FIG. 16, similarly with the above-described embodiment illustrated in FIG. 11, the cooling member 110 in this embodiment includes a cooling surface member 140 having a cooling surface 141 to slidingly contact, e.g., a front-side endless belt 161 and a heat exchanging member 120 having a flow channel 122 for cooling liquid. The heat exchanging member 120 includes a heat exchanging base member 121, sealing members 128, and tubular connection members 129*a*. The heat exchanging base member 121 has plural holes constituting the flow channel 122. The sealing members 128 constitute folded portions of the flow channel 122. The connection members 129*a* connect a rubber tube 184 of an external radiator 180 and the flow channel 122.

However, the configuration in which the cooling surface member 140 and the cooling surface member 140 are simply joined together like the cooling member 110 in the above-described embodiment illustrated in FIG. 11, for example, the following failure might occur. For example, for the heat exchanging member 120 having the flow channel 122 for cooling liquid constituting a liquid-cooling-type cooling unit, the cooling liquid might leak from joint portions of the sealing members 128 and the connection members 129*a*. In addition, if the humidity of air is high near the cooling member 110, condensation might occur on the surfaces of the cooling surface member 140 and the heat exchanging member 120. Even in a configuration in which the heat exchanging member 120 does not have the flow channel 122 for cooling liquid constituting a liquid-cooling-type cooling unit, such condensation may occur. As described above, if the cooling liquid leaks or condensation occurs, a sheet P or the front-side endless belt 161 might become wet with leaked cooling liquid or condensed moisture, thus hampering proper image formation or causing failure, such as transport failure of the sheet P or the front-side endless belt 161.

To prevent wetting of the sheet P or the front-side endless belt 161 due to, e.g., condensation on the surfaces of the cooling surface member 140 and the heat exchanging member 120, it is conceivable to employ a configuration in which both ends of the cooling member 110 in the sheet width direction, from which the cooling liquid might be leak, are covered with cap members. However, such a configuration might have, for example, the following failure. For example, in a configuration in which both ends of the cooling member 110, in other words, both ends of the cooling surface member 140 and the heat exchanging member 120 have the same width and covered with common cap members, moisture of leaked cooling liquid might enter a gap between the cooling surface member 140 and the heat exchanging member 120. Such moisture of leaked cooling liquid might affect the contact state of the cooling surface member 140 and the heat exchanging member 120 or degrade the cooling surface member 140, the heat exchanging member 120, the heat transfer grease 137, or the heat conductive sheet 138.

Hence, the cooling member 110 according to this embodiment has the following configuration. As shown in a side view of the cooling member 110 after joining illustrated in the right side of a plan view in FIG. 16, the cooling surface member 140 has a shorter length in the sheet width direction than the heat exchanging member 120 having both end faces near portions subjected to condensation or liquid leakage. In other words, positions of both end faces of the heat exchanging member 120 near the portions subjected to condensation or liquid leakage are different from positions of both end faces of the cooling surface member 140. Such a configuration can suppress spreading of condensed moisture or cooling liquid leaked from the vicinity of both end faces of the heat exchanging member 120 to a gap between the cooling surface member 140 and the heat exchanging member 120 directly or indirectly joined together, via both end faces of the heat exchanging member 120.

In addition, in this embodiment, the caps 151*a* and 151*b* serving as cap members are disposed to cover only both ends of the heat exchanging member 120 (heat exchanging base member 121) in the sheet width direction. For example, the cap 151*b* having two holes inserted with two connection members 129*a* is mounted on a side of the heat exchanging member 120 at which the connection members 129*a* are provided. The cap 151*a* having no holes is mounted on the opposite side at which the connection members 129*a* are not provided. In FIG. 16, an upper one of each of the caps 151*a* and 151*b* serving as cap members shows a side face of each end seen from the outside, and a lower one thereof shows a side face seen from a center side in the sheet transport direction. Even if the joining portions of the sealing members 128 and the connection members 129*a* integrally formed with the heat exchanging base member 121 by, e.g., adhesion, resin integrated molding, or brazing deteriorate and leak cooling liquid from a gap, the leaked cooling liquid can be enclosed with the caps 151*a* and 151*b*. Such a configuration prevents damage from spreading to the outside.

In addition, the positions of both end faces in the sheet width direction are different between the cooling surface member 140 and the heat exchanging member 120. Accordingly, even if cooling liquid leaks near the both ends of the heat exchanging member 120 and moisture of the leaked liquid is enclosed in the caps 151*a* and 151*b*, such a configuration can suppress incorporation of the moisture of the leaked liquid into a gap between the cooling surface member 140 and the heat exchanging member 120. In other words, such a configuration can suppress spreading of the moisture of cooling liquid, which has leaked from the heat exchanging member 120, via both end faces of the heat exchanging member 120. Accordingly, such a configuration can suppress incorporation of the moisture of leaked cooling liquid into between the cooling surface member 140 and the heat exchanging member 120, thus suppressing adverse effect of the moisture of leaked cooling liquid to the contact state of the cooling surface member 140 and the heat exchanging member 120. As a result, such a configuration can suppress deterioration of, e.g., the cooling surface member 140, the heat exchanging member 120, or the heat transfer grease 137.

Next, a cooling device 100 according to another embodiment of this disclosure is described with reference to FIG. 17.

Figure 17:
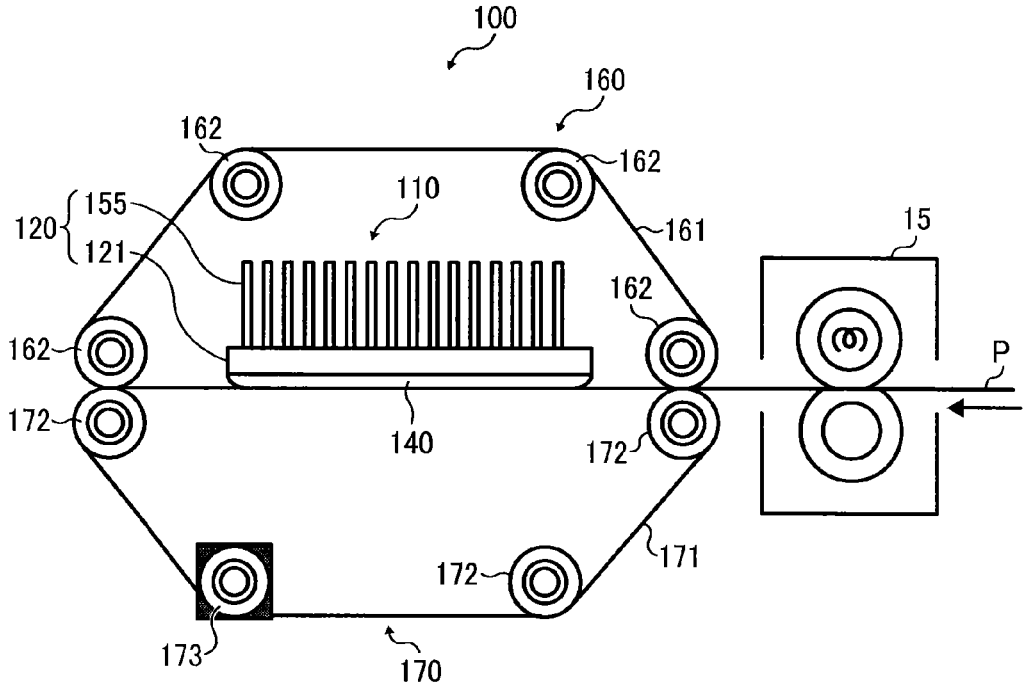
FIG. 17 is a schematic view of a cooling member of a cooling device according to an embodiment of this disclosure in which the cooling member is provided with a cooling fin.
Figure 18:
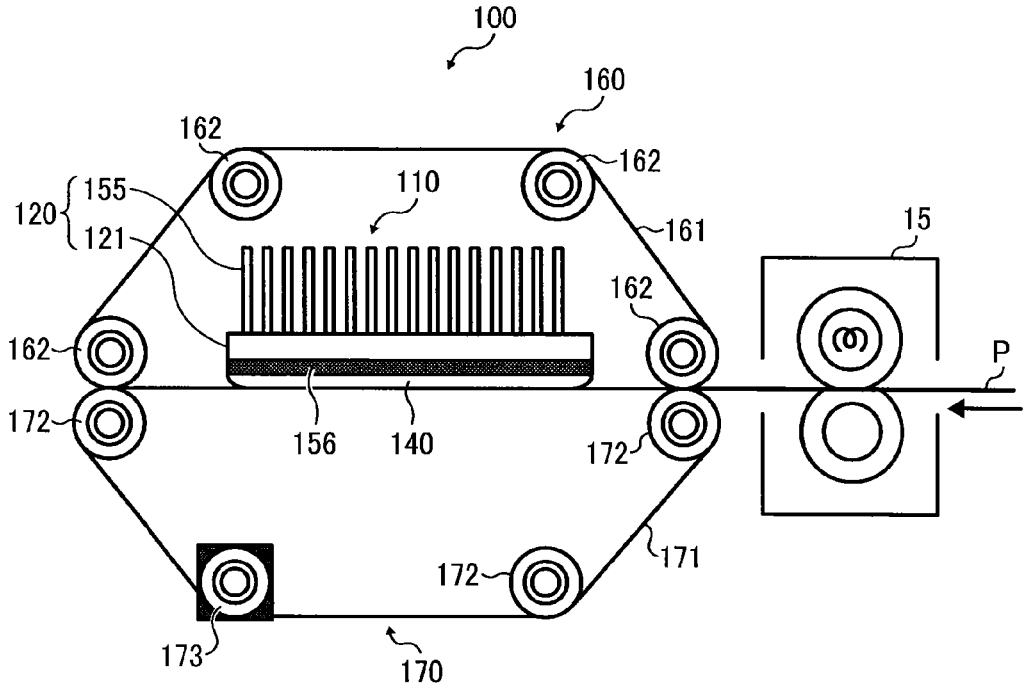
FIG. 18 is a cooling member of a cooling device according to an embodiment of this disclosure in which the cooling member is provided with a cooling fin and a Peltier device.
Figure 19A:
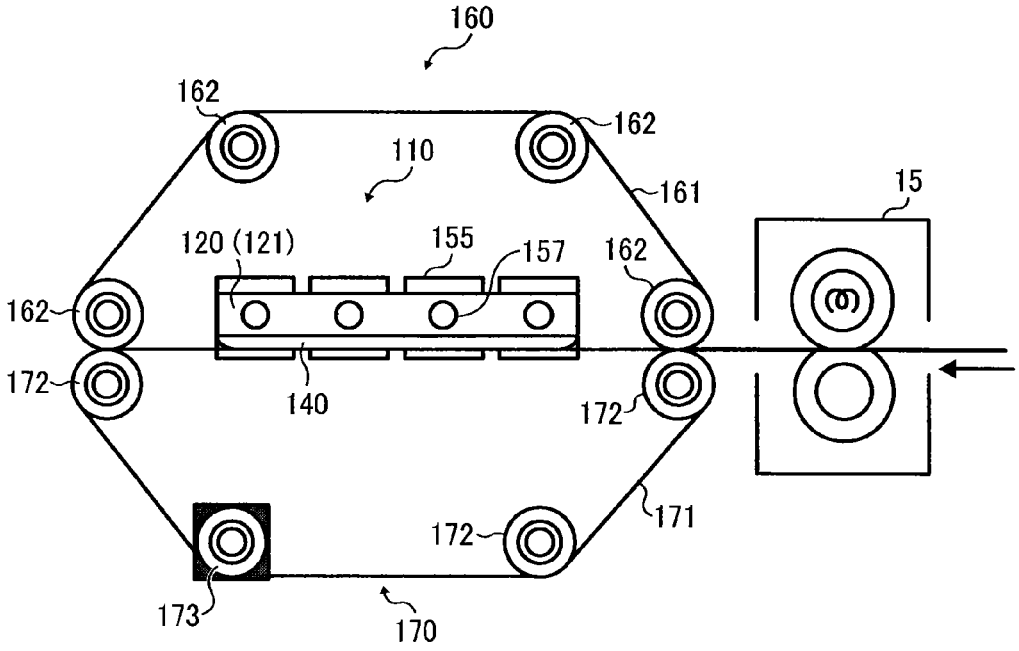
FIGS. 19A and 19B are schematic views of a cooling member of a cooling device according to an embodiment of this disclosure in which the cooling member is provided with a bar-shaped heat sink.
Figure 19B:
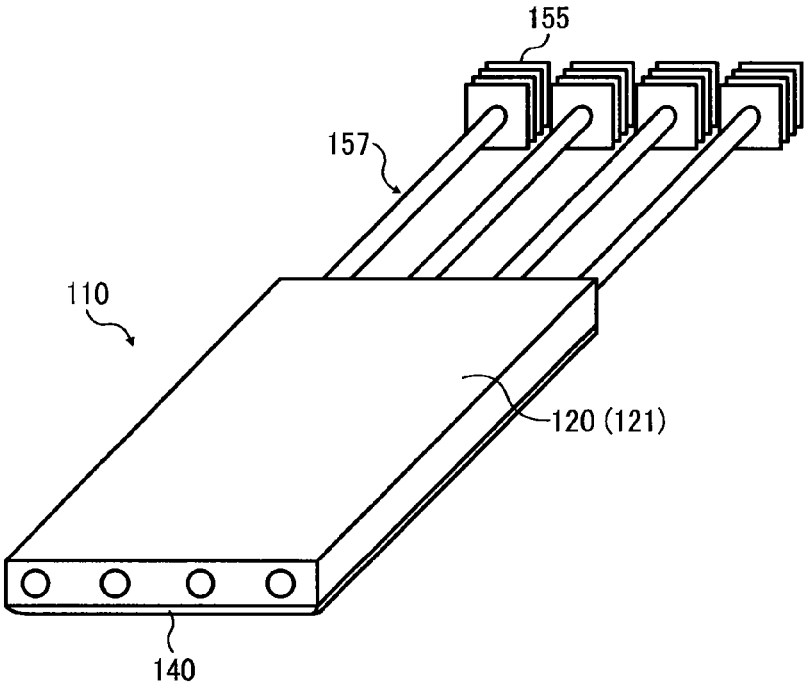

FIG. 17 is a schematic view of an example of the cooling device 100 according to this embodiment in which a cooling member 110 has a cooling fin 155. FIG. 18 is a schematic view of an example of the cooling device 100 according to this embodiment in which a cooling member 110 has a cooling fin 155 and a Peltier device 156. FIGS. 19A and 19B are schematic views of an example of the cooling device 100 according to this embodiment in which a cooling member 110 has a bar-shaped heat sink 157. FIG. 19A is a side view of an example of the cooling device 100 including the bar-shaped heat sink 157. FIG. 19B is a perspective view of the example of the cooling member 110 including the bar-shaped heat sink 157.

This embodiment differs from the above-described embodiments illustrated in FIGS. 3A through 16 in a cooling system formed of a cooling unit of the cooling member 110. Except for the different points, this embodiment is substantially the same as the above-described embodiments of FIGS. 3A through 16. Therefore, substantially the same configuration and action, and operation and effects thereof as the above-described embodiments of FIGS. 3A through 16 are omitted below as needed.

The cooling unit of the cooling member disposed in the cooling device 100 according to any of the above-described embodiment illustrated in FIGS. 3A through 16 is a liquid cooling system. By contrast, in this embodiment, examples of other type cooling system is described below.

In an embodiment of this disclosure, as illustrated in FIG. 17, the cooling system formed of the cooling unit of the cooling member disposed in the cooling device 100 may be an air cooling system that radiates heat from the cooling fin 155 directly disposed at the heat exchanging member 120. Alternatively, in another embodiment of this disclosure, the cooling system may be a system that radiates heat from the cooling fin 155 directly disposed at the heat exchanging member 120 and radiates heat in connection with the Peltier device 156 disposed between the cooling surface member 140 and the heat exchanging member 120. Here, for the system of radiating heat in connection with the Peltier device 156, unlike other examples, the cooling surface member 140 and the heat exchanging member 120 are indirectly joined together via the Peltier device 156. As illustrated in FIGS. 19A and 19B, the system may be an air cooling system in which the bar-shaped heat sink 157 having the cooling fin 155 is disposed at one end of the heat exchanging member 120 to radiate heat.

Next, a cooling device 100 according to another embodiment of this disclosure is described with reference to FIGS. 20A and 20B.

Figure 20A:
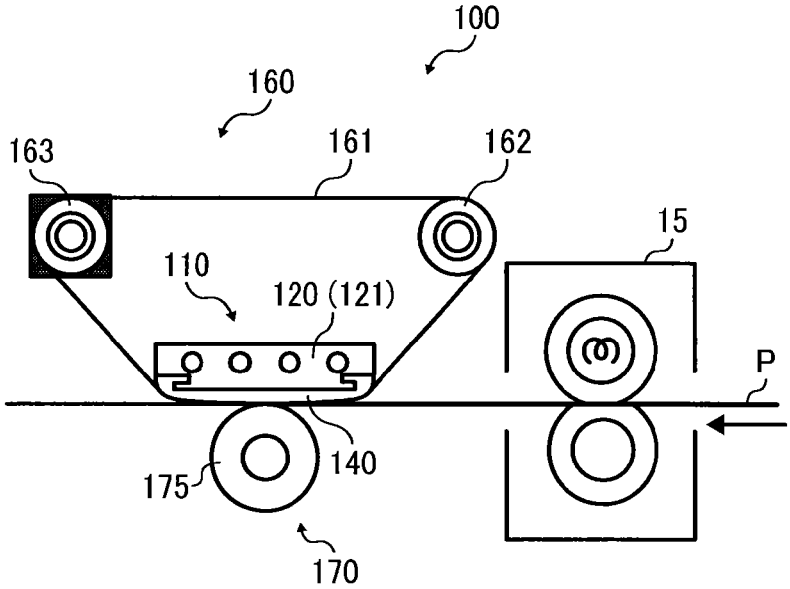
FIGS. 20A and 20B are schematic views of examples of a cooling device according to an embodiment of this disclosure.
Figure 20B:
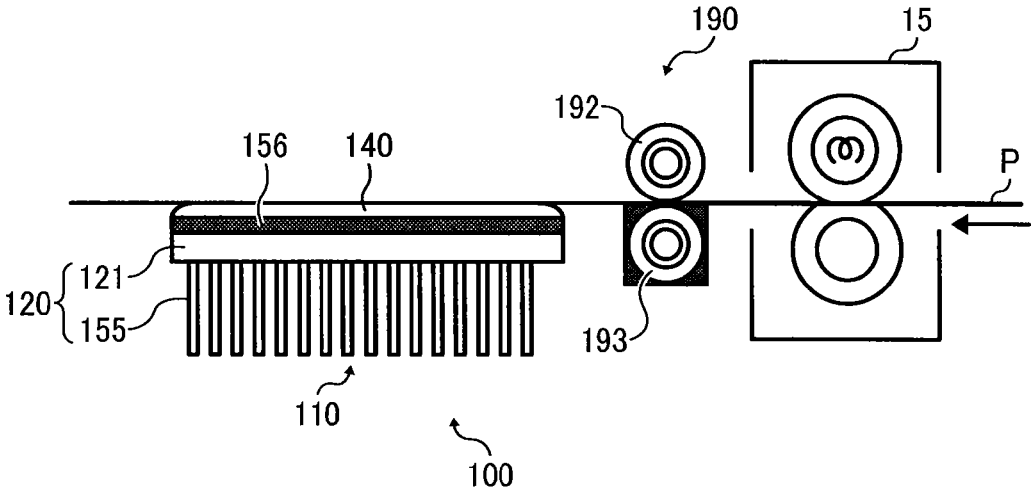

FIGS. 20A and 20B are schematic views of examples of the cooling device 100 according to this embodiment. FIG. 20A is a side view of an example of the cooling member 110 in which a cooling member 110 is disposed on inner circumferential surface of a front-side endless belt 161 of a front-side sandwiching part 160 and a back-side sandwiching part 170 is configured as an opposed roller 175. FIG. 20B is a schematic view of an example of the cooling member 110 in which a cooling member 110 has a cooling surface 141 to directly contact a sheet P from below a transport path of the sheet P.

This embodiment differs from the above-described embodiments illustrated in FIGS. 3A through 19B with respect to a configuration of each of the front-side sandwiching part 160 and the back-side sandwiching part 170 on which the cooling surface 141 of the cooling member 110 is provided or a way of contacting the sheet P. Except for the different points, this embodiment is substantially the same as the above-described embodiments illustrated in FIGS. 3A through 19B. Therefore, substantially the same configuration and action, and operation and effects thereof as in the above-described embodiments illustrated in FIGS. 3A through 19B are omitted below as needed.

Any of the above-described embodiments illustrated in FIGS. 3A through 19B employs an indirect contact system in which the cooling surface 141 contacts the sheet P via at least one of the front-side endless belt 161 and the back-side endless belt 171 disposed at the front-side sandwiching part 160 and the back-side sandwiching part 170, respectively. By contrast, for this embodiment, as described below, the system of contacting a cooling surface 141 with a sheet P may be any of an indirect contact system in which a front-side sandwiching part 160 and a back-side sandwiching part 170 have different configurations and a direct contact system in which the cooling surface 141 directly contacts the sheet P.

For example, the cooling device 100 according to this embodiment has the following configuration. As illustrated in FIG. 20A, the cooling device 100 according to this embodiment employs an indirect contact system in which a cooling surface 141 of a cooling member 110 contacts a sheet P via an inner circumferential surface of a front-side endless belt 161 of a front-side sandwiching part 160. In addition, a back-side sandwiching part 170 is formed of an opposed roller 175. Alternatively, as illustrated in FIG. 20B, a cooling device 100 may have a cooling surface 141 to directly contact a sheet P. In such a configuration, a guide roller to guide the sheet P or an opposed roller may be disposed at a side opposite the cooling surface member 140 via the sheet P. In addition, the cooling member 110 is not limited to the example including the cooling fin 155 and the Peltier device 156 and may be any cooling member described in the above-described embodiments illustrated in FIGS. 3A through 19B.

Next, a cooling device 100 according to another embodiment of this disclosure is described with reference to FIGS. 21A and 21B.

Figure 21A:
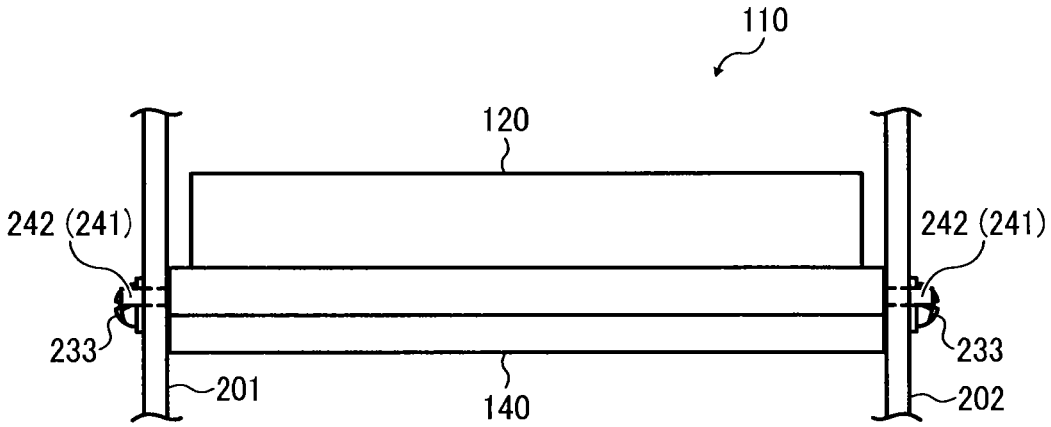
FIGS. 21A and 21B are schematic views of positioning members and fastening members of a cooling member according to an embodiment of this disclosure.
Figure 21B:
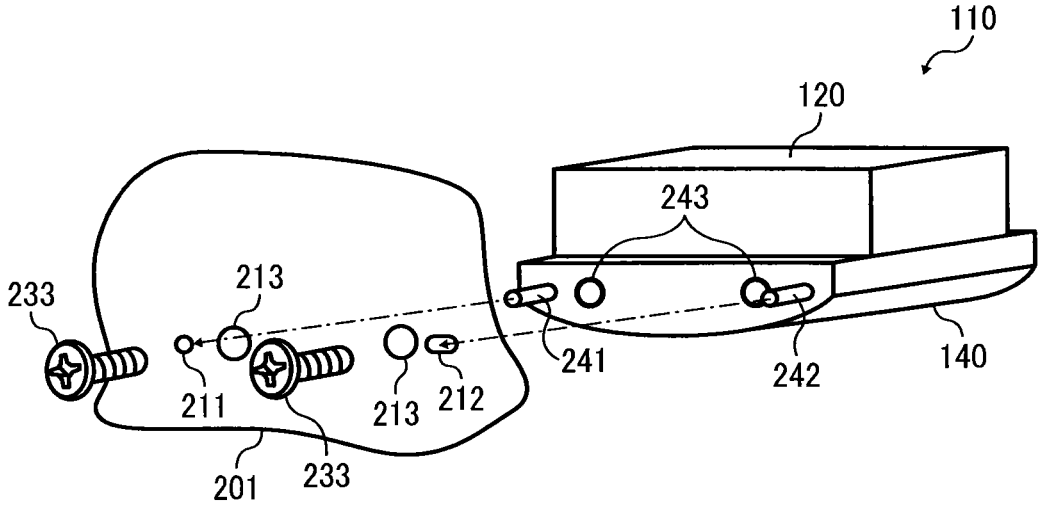
Figure 22:
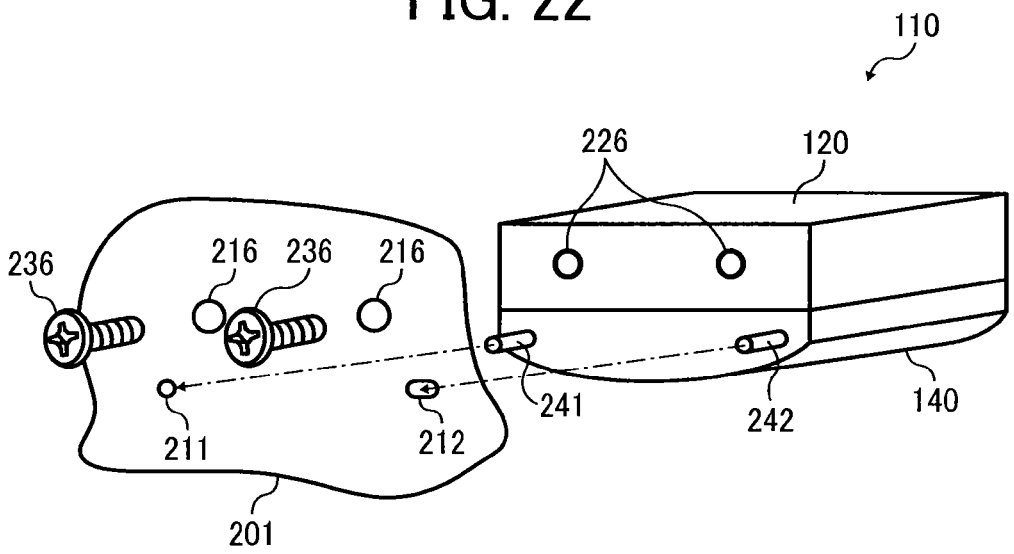
FIG. 22 is a schematic view of positioning members and fastening members of a cooling member according to a variation of the embodiment illustrated in FIGS. 21A and 21B.
Figure 23:
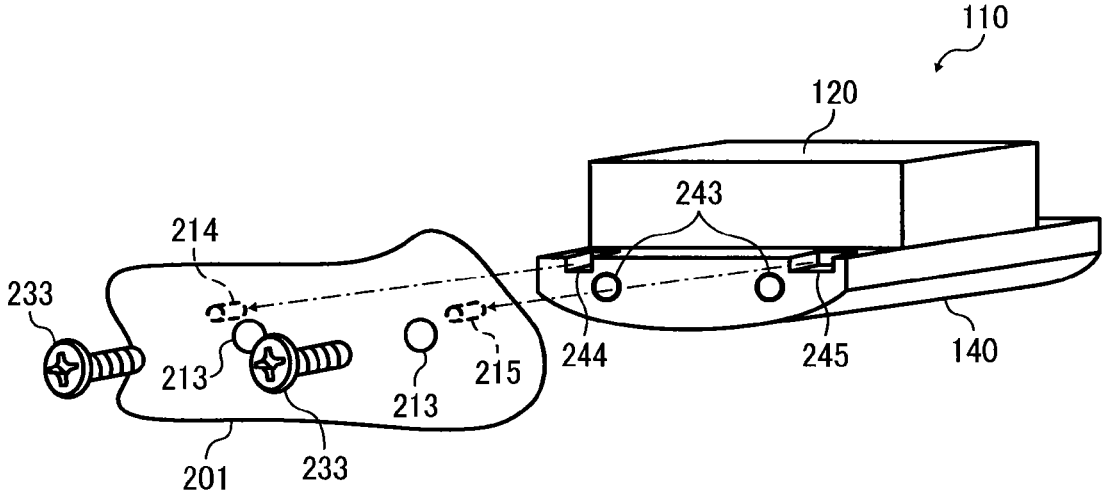
FIG. 23 is a schematic view of positioning members and fastening members of a cooling member according to another variation of the embodiment illustrated in FIGS. 21A and 21B.

FIGS. 21A and 21B are schematic views of positioning and fastening members of a cooling surface member 140 in this embodiment. FIG. 21A is a side view of a cooling member 110 of the cooling device 100 according to this embodiment. FIG. 21B is a perspective view of the cooling member 110 of FIG. 21A. FIG. 22 is a perspective view of a variation of the positioning and fastening members of the cooling surface member 140 in this embodiment. FIG. 23 is a perspective view of another variation of the positioning and fastening members of the cooling surface member 140 in this embodiment.

This embodiment differs from the above-described embodiments illustrated in FIGS. 3A through 20B in that the cooling surface member 140 has positioning members and fastening members relative to a sheet conveyance unit including the front-side sandwiching part 160 and the back-side sandwiching part 170 of the cooling device 100. Except for the different points, this embodiment is substantially the same as the above-described embodiments of FIGS. 3A through 20B. Therefore, substantially the same configuration and action, and operation and effects thereof as in the above-described embodiments of FIGS. 3A through 20B are omitted below as needed.

As in the above-described embodiment illustrated in FIG. 2, the cooling device 100 according to this embodiment has two sandwiching parts, i.e., a front-side sandwiching part 160 and a back-side sandwiching part 170 to sandwich and convey a sheet P. The front-side sandwiching part 160 sandwiches the sheet P from the front side of the sheet P. The back-side sandwiching part 170 sandwiches the sheet P from the back side of the sheet P. The front-side sandwiching part 160 and the back-side sandwiching part 170 form a sheet conveyance unit serving as a recording-material conveyance unit to sandwich and convey the sheet P. The front-side sandwiching part 160 has a front-side endless belt 161 to slidingly contact the cooling surface 141 of the cooling surface member 140 in the cooling member 110. The front-side sandwiching part 160 also has four front-side follow rollers 162 arranged in a trapezoidal shape. The four front-side follow rollers 162 are rotatably supported by a shaft member. The shaft member is fixed at a front side plate 201 and a back side plate 202 forming part of the front-side sandwiching part 160.

The cooling member 110 of the cooling device 100 is also fixed at the front side plate 201 and the back side plate 202, in other words, the sheet conveyance unit. Accordingly, the cooling member 110 or the cooling surface member 140 is removed and mounted according to any of the following two ways or any other suitable way. In a first way, with one of the front side plate 201 and the back side plate 202 removed, the cooling member 110 or the cooling surface member 140 is removed from or mounted on the other. After the removed one is mounted at a predetermined position, the cooling member 110 or the cooling surface member 140 is fastened to the removed one with fastening members. In a second way, when the front side plate 201 and the back side plate 202 are removed, the cooling member 110 or the cooling surface member 140 released from fastening members is extracted from a space between the front side plate 201 and the back side plate 202 to which the front-side follow rollers 162 are fastened. When the front side plate 201 and the back side plate 202 are mounted, the cooling member 110 or the cooling surface member 140 is inserted into the space between the front side plate 201 and the back side plate 202 to which the front-side follow rollers 162 are fastened. After the mounting, the cooling member 110 or the cooling surface member 140 is fastened with the fastening members.

The cooling device 100 according to this embodiment employs the first way and the configuration of removing the front side plate 201. However, when the cooling member 110 or the cooling surface member 140 is mounted, the cooling member 110 or the cooling surface member 140 is positioned and preliminarily fixed to the back side plate 202. When the front side plate 201 is fixed at a predetermined position, the cooling member 110 or the cooling surface member 140 is positioned and finally fixed to the front side plate 201. If a desired positional accuracy cannot be obtained by positioning of the preliminary fixing and final fixing, the cooling surface 141 of the cooling surface member 140 might not adhere to the front-side endless belt 161, thus reducing the cooling performance of the cooling device 100. In addition, since the mounting operation is conducted in a small space, it might be difficult to enhance the operability and maintain a desired positional accuracy.

Hence, for the cooling device 100 according to this embodiment, the cooling surface member 140 of the cooling member 110 has the positioning members and fastening members relative to the front-side sandwiching part 160 serving as a sheet conveyance unit. In other words, the cooling surface member 140 has the positioning members and fastening members relative to the front side plate 201 and the back side plate 202 of the front-side sandwiching part 160 having the front-side endless belt 161 that slides over the cooling surface 141 of the cooling surface member 140 in the cooling member 110. As a fastening method of joining the cooling surface member 140 and the heat exchanging member 120 that constitute the cooling member 110, the cooling device 100 according to this embodiment employs the screw fastening system using the screws 131, which is described in the above-described embodiment illustrated in FIGS. 3A to 3C.

When the cooling member 110 is mounted to the front side plate 201 and the back side plate 202, as illustrated in FIG. 21A, surface-member positioning protrusions 241 and surface-member loose protrusions 242 serving as positioning members protruding from the front side plate 201 and the back side plate 202, respectively, are disposed at the cooling surface member 140. Each of the surface-member positioning protrusions 241 and the surface-member loose protrusions 242 has a pin (cylindrical-column) shape. As illustrated in FIG. 21B, one of the surface-member positioning protrusions 241 and one of the surface-member loose protrusions 242 are arranged side by side at a distance in the sheet transport direction and at a side face (hereinafter, end face) of each end of the cooling surface member 140 in the sheet width direction. Each of the front side plate 201 and the back side plate 202 has a side-plate positioning hole 211 and a side-plate loose hole 212 serving as positioning holes at positions corresponding to the surface-member positioning protrusion 241 and the surface-member loose protrusion 242, respectively. The side-plate loose hole 212 is a long hole laterally extending in FIG. 21B. For example, when the cooling surface member 140 is positioned relative to the front side plate 201, the surface-member positioning protrusion 241 is fitted into the side-plate positioning hole 211 and the surface-member loose protrusion 242 is fitted into the side-plate loose hole 212. It is to be noted that the cooling surface member 140 can also be positioned relative to the back side plate 202 in the same manner.

As described above, the cooling surface member 140 is positioned relative to the front side plate 201 and the back side plate 202 with the surface-member positioning protrusions 241 and the surface-member loose protrusions 242 that are arranged side by side away from each other in the sheet transport direction and at both end faces of the cooling surface member 140. Thus, the cooling surface member 140 can be maintained at a desired positional accuracy. The front side plate 201 has side-plate screw holes 21. The cooling surface member 140 has surface-member screw holes 243, which are screw holes for screw fastening, serving as fastening members. After the positioning, as illustrated in FIG. 21B, fastening screws 233 are screwed into the surface-member screw holes 243 through the side-plate screw holes 213 of the front side plate 201. Thus, the cooling surface member 140 is finally fixed to the front side plate 201 with the fastening screws 233. The back side plate 202 and a side of the cooling surface member 140 facing the back side plate 202 have substantially the same configuration as the front side plate 201 and the other side of the cooling surface member 140 facing the front side plate 201.

By positioning and fastening the front-side sandwiching part 160 and the cooling surface member 140 relative to the front side plate 201 and the back side plate 202 of the front-side sandwiching part 160 as described above, the front-side sandwiching part 160 and the cooling surface member 140 can be arranged with high accuracy. As a result, the cooling surface 141 of the cooling surface member 140 and the front-side endless belt 161 can adhere to each other. Accordingly, the cooling surface member 140 having the positioning members relative to the front-side sandwiching part 160 can provide, e.g., the following effect. For example, such a configuration allows the cooling surface 141 to be positioned by the surface-member positioning protrusion 241 and the surface-member loose protrusion 242 which are common members disposed at the cooling surface member 140. Thus, the cooling surface 141 can be brought into contact with a sheet P via the front-side endless belt 161 at high accuracy without accumulated errors. In addition, it is sufficient that the heat exchanging member 120 contacts the cooling surface member 140 properly in heat transfer, and high accuracy is not necessarily needed for the shape of the heat exchanging member 120, thus allowing cost reduction.

Furthermore, for the cooling device 100 according to this embodiment, as described above, the surface-member positioning protrusion 241 and the surface-member loose protrusion 242 serving as the positioning members are disposed at the side face of each end of the cooling surface member 140 serving as the cooling surface member. Thus, with a simple configuration, the cooling surface member 140 can be positioned relative to the front side plate 201 and the back side plate 202 serving as side plates to support the sheet conveyance unit that includes the front-side sandwiching part 160 and the back-side sandwiching part 170 serving as the recording-material conveyance unit.

Next, another variation of the positioning members and the fixing members of the cooling surface member 140 in this embodiment is described below. This variation differs from the above-described embodiment illustrated in FIGS. 21A and 21B in that, for a cooling device 100 according to this variation, a heat exchanging member 120 has fastening members to fasten the front-side sandwiching part 160 serving as a sheet conveyance unit (recording-material conveyance unit). Except for the different points, this embodiment is substantially the same as the above-described embodiment of FIGS. 21A and 21B. Therefore, substantially the same configuration and action, and operation and effects thereof as the above-described embodiment of FIGS. 21A and 21B are omitted below as needed.

For the cooling device 100 according to this variation, unlike the above-described embodiment of FIGS. 21A and 21B, two surface-member screw holes 243 serving as fastening members relative to a front side plate 201 are disposed at each end face of the heat exchanging member 120 in the sheet width direction as illustrated in FIG. 22. In addition, end faces of the heat exchanging member 120 and the cooling surface member 140 are placed on the same plane at each end in the sheet width direction. Although not illustrated in FIG. 22, the heat exchanging member 120 also has two surface-member screw holes 243 at a side of the heat exchanging member 120 facing a back side plate 202. As described above, in this variation, the heat exchanging member 120 has the fastening members relative to the front side plate 201 and the back side plate 202 of the front-side sandwiching part 160 serving as the recording-material conveyance unit. Such a configuration allows removal and mounting of the cooling surface member 140 in a state in which the heat exchanging member 120 remains in the front-side sandwiching part 160.

For example, with the heat exchanging member 120 fixed to the back side plate 202, the front side plate 201 can be removed. In such a case, as described in the above-described embodiment illustrated in FIGS. 3A to 3C, fastening of the heat exchanging member 120 and the cooling surface member 140 with screws 131 is released, and the cooling surface member 140 is removed toward a side at which the front side plate 201 is removed. In addition, when the cooling surface member 140 is mounted, the side of the heat exchanging member 120 facing the back side plate 202 is fixed at a positioned state. Accordingly, a surface-member positioning protrusion 241 and a surface-member loose protrusion 242 at a side of the cooling surface member 140 facing the back side plate 202 are fitted into a side-plate positioning hole 211 and a side-plate loose hole 212 of the back side plate 202, thus allowing the cooling surface member 140 to be easily positioned at the side facing the back side plate 202. Then, with a side of the cooling surface member 140 facing the front side plate 201 pressed against the heat exchanging member 120, the front side plate 201 is fixed at a predetermined position, thus allowing the cooling surface member 140 to be easily positioned at the side facing the front side plate 201.

Thus, in addition to the effect of the above-described embodiment of FIGS. 21A and 21B, this variation can provide the cooling device 100 having good operability in maintenance of the cooling surface 141 of the cooling surface member 140

Next, another variation of the positioning members and the fixing members of the cooling surface member 140 in this embodiment is described below.

This variation differs from the above-described embodiment illustrated in FIGS. 21A and 22A in that, as positioning members relative to a front-side sandwiching part 160, a cooling device 100 according to this variation has groove-shaped positioning members near each end of a joint portion of the cooling surface member 140 with the heat exchanging member 120. Except for the different points, this embodiment is substantially the same as the above-described embodiment of FIGS. 21A and 21B. Therefore, substantially the same configuration and action, and operation and effects thereof as the above-described embodiment of FIGS. 21A and 21B are omitted below as needed.

As illustrated in FIG. 23, unlike the above-described embodiment of FIGS. 21A and 21B, the cooling device 100 according to this variation has, as the positioning members relative to the front-side sandwiching part 160, a rectangular surface-member positioning groove 244 and a rectangular surface-member loose groove 245 near each end of the joint portion (surface) of the cooling surface member 140 with the heat exchanging member 120. The front side plate 201 has a side-plate positioning protrusion 214 and a side-plate loose protrusion 215 serving as cylindrical (pin-shaped) positioning protrusions at positions corresponding to the surface-member positioning groove 244 and the surface-member loose groove 245, respectively. Although not illustrated in FIG. 23, the cooling surface member 140 also has a surface-member positioning groove 244 and a surface-member loose groove 245 at a side facing the back side plate 202. The back side plate 202 also has a side-plate positioning protrusion 214 and a side-plate loose hole 245 corresponding to the surface-member positioning groove 244 and the surface-member loose groove 245, respectively. As described above, in this variation, the positioning members are disposed near each end of the joint portion of the cooling surface member 140 with the heat exchanging member 120, thus allowing the cooling surface member 140 to be positioned relative to the front side plate 201 and the back side plate 202 with a simple configuration.

For example, the length of each of the side-plate positioning protrusion 214 and the side-plate loose hole 245 disposed at the front side plate 201 and the back side plate 202, respectively, is designed so that, when the cooling surface member 140 is fixed to each of the front side plate 201 and the back side plate 202, the length is smaller than the depth of each of the surface-member positioning groove 244 and the surface-member loose groove 245 in the sheet width direction. By moving the cooling surface member 140 upward in FIG. 23, bottom portions of the surface-member positioning groove 244 and the surface-member loose groove 245 contact lower sides (in FIG. 23) of the side-plate positioning protrusion 214 and the side-plate loose hole 245, thus the cooling surface member 140 to be positioned with respect to an upward and downward direction in FIG. 23. In addition, by moving the cooling surface member 140 to right side in FIG. 23, side faces (left side faces in FIG. 23) of the surface-member positioning groove 244 and the surface-member loose groove 215 contact left sides (in FIG. 23) of the side-plate positioning protrusion 214 and the side-plate loose hole 245 of each side plate, thus the cooling surface member 140 to be positioned with respect to a lateral direction in FIG. 23. In other words, by moving the cooling surface member 140 to an upstream side in the sheet transport direction, downstream side faces of the surface-member positioning groove 244 and the surface-member loose groove 215 in the sheet transport direction contact downstream sides of the side-plate positioning protrusion 214 and the side-plate loose hole 245 of each side plate in the sheet transport direction, thus the cooling surface member 140 to be positioned with respect to the sheet transport direction. Here, positioning of the cooling surface member 140 in a forward and backward direction in FIG. 23, that is, the sheet transport direction is performed by sandwiching the cooling surface member 140 with both end faces of the cooling surface member 140 or pressing the end face of the cooling surface member 140 facing the back side plate 202 against the back side plate 202.

As described above, the cooling surface member 140 is positioned relative to the front side plate 201 and the back side plate 202 with the surface-member positioning protrusions 241 and the surface-member loose protrusions 242 that are arranged side by side away from each other in the sheet transport direction and at both end faces of the cooling surface member 140. Thus, the cooling surface member 140 can be maintained at a desired positional accuracy. The front side plate 201 has side-plate screw holes 213. The cooling surface member 140 has surface-member screw holes 243, which are screw holes for screw fastening, serving as fastening members. After the positioning, as illustrated in FIG. 23, fastening screws 233 are screwed into the surface-member screw holes 243 through the side-plate screw holes 213 of the front side plate 201. Thus, the cooling surface member 140 is finally fixed to the front side plate 201 with the fastening screws 233. The back side plate 202 and a side of the cooling surface member 140 facing the back side plate 202 have substantially the same configuration as the front side plate 201 and the other side of the cooling surface member 140 facing the front side plate 201.

By positioning and fastening the front-side sandwiching part 160 and the cooling surface member 140 relative to the front side plate 201 and the back side plate 202 of the front-side sandwiching part 160 as described above, the front-side sandwiching part 160 and the cooling surface member 140 can be arranged with high accuracy. As a result, the cooling surface 141 of the cooling surface member 140 and the front-side endless belt 161 can adhere to each other. After the positioning, as illustrated in FIG. 23, the fastening screws 233 are screwed into the surface-member screw holes 243, which serve as the fastening members of the cooling surface member 140, through the side-plate screw holes 213 of the front side plate 201. Thus, the cooling surface member 140 is finally fixed to the front side plate 201 with the fastening screws 233. The back side plate 202 and a side of the cooling surface member 140 facing the back side plate 202 have substantially the same configuration as the front side plate 201 and the other side of the cooling surface member 140 facing the front side plate 201.

By positioning and fastening the front-side sandwiching part 160 and the cooling surface member 140 relative to the front side plate 201 and the back side plate 202 of the front-side sandwiching part 160 as described above, the front-side sandwiching part 160 and the cooling surface member 140 can be arranged with high accuracy. As a result, the cooling surface 141 of the cooling surface member 140 and the front-side endless belt 161 can adhere to each other. Accordingly, similarly with the above-described embodiment of FIGS. 21A and 21B, the cooling surface member 140 having the positioning members relative to the front-side sandwiching part 160 can provide, e.g., the following effect. For example, such a configuration allows the cooling surface 141 to be positioned by the surface-member positioning protrusion 241 and the surface-member loose protrusion 242 which are common members disposed at the cooling surface member 140. Thus, the cooling surface 141 can be brought into contact with a sheet P via the front-side endless belt 161 at high accuracy without accumulated errors. As the positioning members of the cooling surface member 140, the surface-member positioning groove 244 and the surface-member loose groove 245 are disposed at the joint portion of the cooling surface member 140 and the heat exchanging member 120. Thus, the cooling surface member 140 can be positioned relative to each side plate of the front-side sandwiching part 160 with a simple configuration. In addition, it is sufficient that the heat exchanging member 120 contacts the cooling surface member 140 properly in heat transfer, and high accuracy is not necessarily needed for the shape of the heat exchanging member 120, thus allowing cost reduction.

In the above-described embodiments, the cooling device 100 is included in the tandem-type image forming apparatus 300 illustrated as a color printer employing an intermediate transfer system. However, embodiments of the present invention are not limited to such a tandem-type image forming apparatus employing an intermediate transfer system. For example, the image forming apparatus may be a single-color image forming apparatus or a direct-transfer type image forming apparatus. In other words, a cooling device according to an embodiment of the present invention may be incorporated in an electrophotographic image forming apparatus that transfers a toner image on a recording material, such as a sheet P and thermally fixes the toner image on the recording material, to cool the recording material.

In the above-described embodiments, the cooling member 110 is disposed at the front side of the sheet P. However, the arrangement of the cooling member 110 is not limited to the above-described arrangement. For example, at a side of the sheet transport path 32 (in other words, the back side of the sheet P) opposite the cooling member 110 disposed at the front side of the sheet P, another cooling member 110 may be disposed to cool the sheet P from both sides. Such a configuration can more effectively cool the sheet P sandwiched and conveyed.

The above-descriptions relate to limited examples, and the present disclosure includes, e.g., the following aspects giving respective effects described below.

<Aspect A>

A cooling device includes a cooling member (e.g., a cooling member 110) to cool a recording material. The cooling member includes a cooling surface member, a heat exchanging member, and a fastening member. The cooling surface member (e.g., a cooling surface member 140) has a cooling surface (e.g., a cooling surface 141) to directly or indirectly contact the recording material and absorb heat of the recording material to cool the recording material. The heat exchanging member (e.g., a heat exchanging member 120) is directly or indirectly joined to the cooling surface member to radiate heat absorbed by the cooling surface member directly or indirectly via a radiation member (e.g., a radiation member 181). The fastening member (e.g., clamps 135) fastens the cooling surface member and the heat exchanging member to retain a joined state in which the cooling surface member and the heat exchanging member are directly or indirectly joined to each other. The cooling surface member and the heat exchanging member are separable from the joined state to a separated state without damaging the fastening member.

For such a configuration, as in the above-described embodiment(s) illustrated in FIGS. 2 and 3A to 3C (or FIGS. 2 through 9B), the cooling member includes at least two members; that is, the cooling surface member and the heat exchanging member. For such a configuration, in producing the cooling member, post-processing necessary for the cooling surface member and the heat exchanging member are separately performed, thus allowing each of the cooling surface member and the heat exchanging member to be produced at a reduced cost and in a simpler manner. Such a configuration can reduce the production cost of the cooling member and conducting post-processing on the cooling member in more simple manner, as compared to a configuration in which the cool face member and the heat exchanging member are formed as a single member. In addition, the cooling surface member and the heat exchanging member are separable from each other without damaging the fastening members. Accordingly, in maintenance of the cooling surface of the cooling member having been deteriorated due to, e.g., wearing, the condition of the cooling surface is improved by replacing only the cooling surface member having the cooling surface. Accordingly, by providing the heat exchanging member without providing a channel, such as a flow channel 122, of cooling liquid in the cooling surface member 140, the maintenance cost of the cooling surface of the cooling member can be reduced as compared to a configuration in which the cooling surface member and the heat exchanging member are integrally formed as a single member.

In addition, when maintenance work is performed on the cooling surface of the cooling member, a member to be replaced can be limited to the cooling surface member. Such a configuration can obtain good operability in maintenance of the deteriorated cooling surface as compared to the configuration in which the cooling surface member and the heat exchanging member are integrally formed as a single member. For example, for a liquid-cooling-type cooling device, a flexible and deformable material, such as the rubber tube 184, can be used as a tube channel connecting, e.g., a flow channel of the heat exchanging member to an external radiation unit, thus obviating, for example, the following work. Examples of such work include preliminary removal of the cooling liquid from the cooling member, replacement of gaskets or other consumable supplies, or replenishment of the cooling liquid into the circulation channel after replacement of the cooling member. Omitting such work allows enhancement of operability in maintenance of the deteriorated cooling surface. Such a configuration can reduce costs in the production of the cooling member to directly or indirectly contact a recording material to cool the recording material and the maintenance of the deteriorated cooling surface of the cooling member, and provide a cooling device having a good operability in maintenance of the deteriorated cooling surface.

<Aspect B>

In Aspect A, the cooling surface (e.g., the cooling surface 141) of the cooling surface member (e.g., the cooling surface 141) is at least partially a curved surface. Such a configuration gives, for example, the following effect as described in the above-described embodiment(s) illustrated in FIGS. 4 and 5 (or FIGS. 2 through 9B). Such a configuration allows a tension applied to a belt member, such as the front-side endless belt 161 or the back-side endless belt 171, to enhance adhesion between the belt member and a recording material (e.g., a sheet P) and between the belt member and the cooling surface of the cooling surface member, thus enhancing the effect of cooling the recording material.

<Aspect C>

In Aspect A or B, the heat exchanging member (e.g., the heat exchanging member 120) includes a cooling unit of, e.g., a liquid cooling type to radiate heat absorbed by the cooling surface member (e.g., the cooling surface member 140) directly or indirectly via the radiation member (e.g., the radiator 181) through transfer of the heat to the radiation member. Such a configuration gives, for example, the following effect as described in the above-described embodiment(s) illustrated in FIGS. 2 and 3A though 3C (or FIGS. 2 through 9B). That is, the cooling unit radiates heat directly or from, e.g., the cooling fin of an air cooling type provided at the heat exchanging member or indirectly from the radiation member through transfer of heat to the radiation member. Such a configuration more effectively radiates heat of the recording material absorbed by the cooling surface member than a configuration in which the heat exchanging member is made of only a base material. Thus, the cooling effect can be further enhanced.

<Aspect D>

In any one of Aspects A, B, and C, the cooling surface (e.g., the cooling surface 141) of the cooling surface member (e.g., the cooling surface member 140) has a higher hardness than the heat exchanging member (e.g., the heat exchanging member 120). As in the above-described embodiment(s) illustrated in FIG. 6 (or FIGS. 2 through 9B), such a configuration can enhance the wear resistance of the cooling surface of the cooling surface member to slidingly contact the recording material (e.g., the sheet P) or the belt member (e.g., the front-side follow rollers 162), thus allowing the cooling surface of the cooling surface member to be maintained in good condition over a long period of time. In addition, such a configuration can limit a member or part having a wear resistance enhanced by surface processing to the cooling surface member or the cooling surface (contact surface). Occurrence of deterioration or a dimensional change due to extra surface processing to, e.g., the heat exchanging member can be prevented, thus allowing a reduction in cost of the cooling member and an increase in productivity.

<Aspect E>

In any one of Aspects A through D, the cooling surface (e.g., the cooling surface 141) has a lower friction coefficient than the heat exchanging member (e.g., the heat exchanging member 120). As in the above-described embodiment(s) illustrated in FIG. 6 (and FIGS. 2 through 9B), such a configuration can obtain smooth sliding performance of the recording material (e.g., the sheet P) or the belt member (e.g., the front-side endless belt 161) to slide over the cooling surface of the cooling surface member, thus suppressing damage to the recording material or the belt member. Such a configuration can also reduce loads to a driving source (e.g., a driving motor) to convey the recording material or a driving source to endlessly move the belt member, thus allowing energy saving. The member or part having a friction coefficient reduced by surface processing can be limited to the cooling surface (contact surface) of the cooling surface member, thus allowing a reduction in cost and an increase in productivity of the cooling member (e.g., the cooling member 110).

<Aspect F>

In any one of Aspects A through E, the cooling surface (e.g., the cooling surface 141) of the cooling surface member (e.g., the cooling surface member 140) has a higher thermal conductivity than the heat exchanging member (e.g., the heat exchanging member 120). Such a configuration gives, for example, the following effect as described in the above-described embodiment(s) illustrated in FIG. 6 (or FIGS. 2 through 9B). When the cooling surface of the cooling surface member contacts the recording material (e.g., the sheet P) or the belt member (e.g., the front-side endless belt 161) to absorb heat of the recording material, such a configuration can enhance the heat absorbing efficiency of the cooling surface of the cooling surface member, thus enhancing the effect of cooling the recording material by the cooling member (e.g., the cooling member 110). The member or part having a thermal conductivity increased by surface processing can be limited to the cooling surface (contact surface) of the cooling surface member, thus allowing a reduction in cost and an increase in productivity of the cooling member (e.g., the cooling member 110).

<Aspect G>

In any one of Aspects A through F, the cooling surface member (e.g., the cooling surface member 140) has a joint surface (the joint surface 143). The heat exchanging member (e.g., the heat exchanging member 120) has a joint surface (e.g., a joint surface 123) to directly or indirectly join the joint surface of the cooling surface member. The cooling member includes a heat conductive material (e.g., a heat transfer grease 137 or a heat conductive sheet 138) to fill a crack between the joint surface of the cooling surface member and the joint surface of the heat exchanging member. As in the above-described embodiments illustrated in FIGS. 4 and 5 (or FIGS. 2 through 9B), filling cracks between the joint surfaces with the heat conductive material can prevent the cracks from reducing heat transfer efficiency, thus suppressing a reduction in the effect of cooling the recording material (e.g., the sheet P). Such a configuration can also obtain a desired heat transfer efficiency even if post-processing for preventing occurrence of cracks, such as grinding of each of the joint surfaces into a desired surface shape or rubbing of the joint surfaces against each other is omitted or the accuracy of such post-processing is reduced, <Aspect H>

In Aspect G, the heat conductive material (e.g., the heat transfer grease 137 or the heat conductive sheet 138) has a thermal conductivity of 0.8 W/mK or greater at room temperature. Such a configuration gives, for example, the following effect as described in the above-described embodiment(s) illustrated in FIGS. 4 and 5 (or FIGS. 2 through 9B). For example, good heat transfer efficiency can be obtained between the joint surface of the cooling surface member (e.g., the cooling surface member 140) and the joint surface of the heat exchanging member (e.g., the heat exchanging member 120) that are directly or indirectly joined to each other, thus allowing enhancement of the cooling effect of cooling the recording material (e.g., the sheet P).

<Aspect I>

In Aspect G or H, the heat conductive material (e.g., the heat transfer grease 137 or the heat conductive sheet 138) is insulative. Such a configuration gives, for example, the following effect as described in the above-described embodiment(s) illustrated in FIGS. 4 and 5 (or FIGS. 2 through 9B). For example, when the cooling surface member (e.g., the cooling surface member 140) and the heat exchanging member (e.g., the heat exchanging member 120) are formed of different types of metal or one of the joint surfaces is processed by, e.g., plating, use of such an insulative material can suppress occurrence of galvanic corrosion which might be caused by a slight current between the joint surfaces.

<Aspect J>

In any one of Aspects A to I, the cooling surface member (e.g., the cooling surface member 140) has a joint surface (143). The heat exchanging member (e.g., the heat exchanging member 120) has a joint surface (e.g., a joint surface 123) to directly or indirectly join the joint surface of the cooling surface member. The joint surface of the cooling surface member and the joint surface of the heat exchanging member directly or indirectly contact each other at a higher contact pressure in a sheet passing portion corresponding to a sheet passing area (e.g., a maximum sheet passing width) through which the recording material passes therebetween than in any other area therebetween. The joint surface of the heat exchanging member has a convex portion that protrudes toward the cooling surface member by a distance $\Delta T$ to obtain the higher contact pressure in the sheet passing portion. As in the above-described embodiment(s) illustrated in FIGS. 6 and 7 (or FIGS. 2 through 9B), such a configuration allows the contact pressure between the joint surface of the cooling surface member and the joint surface of the heat exchanging member to be concentrated on the sheet passing portion corresponding to the sheet passing area. As a result, adhesion between the joint surface of the cooling surface member and the joint surface of the heat exchanging member can be enhanced, thus allowing enhancement of heat transfer efficiency in the sheet passing portion. In a case in which the heat conductive material (e.g., the heat transfer grease 137) is applied to between the heat exchanging member and the cooling surface member, cracks formed in areas near both ends and outside the sheet passing area serve as escapes for surplus of the heat transfer grease. Such a configuration can prevent the heat conductive material from accumulating on the sheet passing portion at an excess thickness, thus suppressing a reduction in thermal conductivity.

<Aspect K>

In any one of Aspects A through J, a mounting angle of the cooling surface member (e.g., the cooling surface member 140) is adjustable relative to the heat exchanging member (e.g., the heat exchanging member 120) in the cooling member (e.g., the cooling member 110). Such a configuration gives, for example, the following effect as described in the above-described embodiment(s) illustrated in FIG. 15 (through FIG. 23). For example, even if variations in the dimensions of component members of the cooling device (e.g., the cooling device 100) cause errors in mounting the cooling member and as a result, an error occurs in the angle of the cooling surface (e.g., the cooling surface 141) relative to the recording material (e.g., the sheet P) or the belt member (e.g., the front-side endless belt 161), the angle is finely adjustable with only the cooling member. Accordingly, even after the cooling member is mounted to the cooling device, the mounting angle of the cooling surface is adjustable, thus enhancing the operability in assembling of the cooling device or maintenance of the cooling surface.

<Aspect L>

In any one of Aspects A through K, each of the cooling surface member (e.g., the cooling surface member 140) and the heat exchanging member (e.g., the heat exchanging member 120) has opposed end faces substantially perpendicular to a width direction of the recording material (e.g., the sheet P) outside a transport area of the recording material in the cooling member. The opposed end faces of the cooling surface member are disposed at different positions from the heat exchanging member. Such a configuration gives, for example, the following effect as described in the above-described embodiment(s) illustrated in FIG. 16 (through FIG. 23). Such a configuration can suppress spreading of condensed moisture or cooling liquid leaked from the vicinity of both end faces of the heat exchanging member, which is the vicinity of portions subjected to condensation or liquid leakage, to a gap between the cooling surface member and the heat exchanging member directly or indirectly joined together, via both end faces of the heat exchanging member.

<Aspect M>

In Aspect L, the cooling member (e.g., the cooling member 110) includes cap members (e.g., caps 151*a*, 151*b*) to cover only the opposed end faces of the heat exchanging member (e.g., the heat exchanging member 120). Such a configuration gives, for example, the following effect as described in the above-described embodiment(s) illustrated in FIG. 16 (through FIG. 23). In other words, such a configuration can suppress spreading of the moisture of, e.g., cooling liquid, which has leaked from the heat exchanging member, to a gap between the cooling surface member (e.g., the cooling surface member 140) and the heat exchanging member, via both end faces of the heat exchanging member. Accordingly, such a configuration can suppress incorporation of the moisture of, e.g., leaked cooling liquid into between the cooling surface member and the heat exchanging member, thus suppressing adverse affect of the moisture of, e.g., leaked cooling liquid to the contact state of the cooling surface member and the heat exchanging member. As a result, such a configuration can suppress deterioration of, e.g., the cooling surface member, the heat exchanging member, or the heat conductive material (e.g., the heat transfer grease 137).

<Aspect N>

In any one of Aspects A through M, the cooling device includes a recording-material conveyance unit formed of e.g., a front-side sandwiching part 160 and a back-side sandwiching part 170 to convey the recording material. A positioning member (e.g., a surface-member positioning protrusion 241 or a surface-member loose protrusion 242) is disposed at the cooling surface member (e.g., the cooling surface member 140) to position the cooling surface member relative to the recording-material conveyance unit. Such a configuration gives the following effect as described in the above-described exemplary embodiments illustrated in FIGS. 21A to 23. For example, the cooling surface member having the positioning member relative to the recording-material conveyance unit allows the cooling surface (e.g., the cooling surface 141) to be positioned by the positioning member disposed at the same member. Such a configuration allows the cooling surface to directly or indirectly contact the recording material with high accuracy without accumulation of errors. In addition, it is sufficient that the heat exchanging member (e.g., the heat exchanging member 120) contacts the cooling surface member properly in heat transfer, and high accuracy is not necessarily needed for the shape of the heat exchanging member 120. Accordingly, such a configuration allows cost reduction of the cooling member (e.g., the cooling member 110).

<Aspect O>

In an image forming apparatus (e.g., image forming apparatus 300 illustrated as a printer) including a cooling device to cool a recording material (e.g., a sheet P), the cooling device is a cooling device (e.g., the cooling device 100) according to any one of the above-described Aspects A through N. As in the above-described embodiments illustrated in FIGS. 1 through 23, such a configuration can provide an image forming apparatus capable of giving effects equivalent to the cooling device according to the above-described aspect A through N.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cooling device comprising a cooling member to cool a recording material, the cooling member including a cooling surface member having a cooling surface to directly or indirectly contact the recording material and absorb heat of the recording material to cool the recording material, a heat exchanging member directly or indirectly joined to the cooling surface member to radiate heat absorbed by the cooling surface member, directly or indirectly via a radiation member, and a fastening member to fasten the cooling surface member and the heat exchanging member to retain a joined state in which the cooling surface member and the heat exchanging member are directly or indirectly joined to each other, wherein the cooling surface member and the heat exchanging member are separable from the joined state to a separated state without damaging the fastening member.

2. The cooling device of claim 1, wherein the cooling surface is at least partially a curved surface.

3. The cooling device of claim 1, wherein the heat exchanging member includes a cooling unit to radiate heat absorbed by the cooling surface member, directly or indirectly via the radiation member.

4. The cooling device of claim 1, wherein the cooling surface has a higher hardness than the heat exchanging member.

5. The cooling device of claim 1, wherein the cooling surface has a lower friction coefficient than the heat exchanging member.

6. The cooling device of claim 1, wherein the cooling surface has a higher thermal conductivity than the heat exchanging member.

7. The cooling device of claim 1, wherein the cooling surface member has a joint surface, the heat exchanging member has a joint surface to directly or indirectly join the joint surface of the cooling surface member, and the cooling member includes a heat conductive material to fill a crack between the joint surface of the cooling surface member and the joint surface of the heat exchanging member.

8. The cooling device of claim 7, wherein the heat conductive material has a thermal conductivity of 0.8 W/mK or greater at room temperature.

9. The cooling device of claim 7, wherein the heat conductive material is insulative.

10. The cooling device of claim 1, wherein the cooling surface member has a joint surface, the heat exchanging member has a joint surface to directly or indirectly join the joint surface of the cooling surface member, and the joint surface of the cooling surface member and the joint surface of the heat exchanging member directly or indirectly contact each other at a higher contact pressure in a sheet passing area through which the recording material passes therebetween than in any other area therebetween.

11. The cooling device of claim 1, wherein each of the cooling surface member and the heat exchanging member has opposed end faces substantially perpendicular to a width direction of the recording material outside a transport area of the recording material in the cooling member, the opposed end faces of the cooling surface member are disposed at different positions from the heat exchanging member.

12. The cooling device of claim 11, further comprising caps to cover only the opposed end faces of the heat exchanging member.

13. An image forming apparatus comprising the cooling device according to claim 1.

14. A cooling device comprising a cooling member to cool a recording material, the cooling member including a cooling surface member having a cooling surface to directly or indirectly contact the recording material and absorb heat of the recording material to cool the recording material, a heat exchanging member directly or indirectly joined to the cooling surface member to radiate heat absorbed by the cooling surface member, directly or indirectly via a radiation member, and a fastening member to fasten the cooling surface member and the heat exchanging member to retain a joined state in which the cooling surface member and the heat exchanging member are directly or indirectly joined to each other, wherein the cooling surface member and the heat exchanging member are separable from the joined state to a separated state without damaging the fastening member, and wherein a mounting angle of the cooling surface member is adjustable relative to the heat exchanging member of the cooling member.

15. A cooling device comprising a cooling member to cool a recording material, the cooling member including a cooling surface member having a cooling surface to directly or indirectly contact the recording material and absorb heat of the recording material to cool the recording material, a heat exchanging member directly or indirectly joined to the cooling surface member to radiate heat absorbed by the cooling surface member, directly or indirectly via a radiation member, and a fastening member to fasten the cooling surface member and the heat exchanging member to retain a joined state in which the cooling surface member and the heat exchanging member are directly or indirectly joined to each other, wherein the cooling surface member and the heat exchanging member are separable from the joined state to a separated state and joinable from the separated state to the joined state.

16. The cooling device of claim 15, wherein the fastening member fastens and unfastens the cooling surface member and the heat exchanging member in a repeatable manner.

17. An image forming apparatus comprising the cooling device according to claim 15.

* * * * *